US009442420B2

(12) United States Patent
Yoshida et al.

(10) Patent No.: US 9,442,420 B2
(45) Date of Patent: Sep. 13, 2016

(54) IMAGE FORMING APPARATUS AND IMAGE FORMING METHOD

(71) Applicants: Akira Yoshida, Tokyo (JP); Kohta Fujimori, Kanagawa (JP); Kayoko Tanaka, Tokyo (JP); Natsumi Matsue, Kanagawa (JP); Kazufumi Kimura, Kanagawa (JP)

(72) Inventors: Akira Yoshida, Tokyo (JP); Kohta Fujimori, Kanagawa (JP); Kayoko Tanaka, Tokyo (JP); Natsumi Matsue, Kanagawa (JP); Kazufumi Kimura, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/877,502

(22) Filed: Oct. 7, 2015

(65) Prior Publication Data

US 2016/0131991 A1 May 12, 2016

(30) Foreign Application Priority Data

Nov. 6, 2014 (JP) ..... 2014-226387

(51) Int. Cl.
*G03G 15/08* (2006.01)

(52) U.S. Cl.
CPC ..... *G03G 15/0862* (2013.01)

(58) Field of Classification Search
CPC combination se(s) only.
See application file for complete search history.

(56) References Cited

U.S. PATENT DOCUMENTS

| | | | |
|---|---|---|---|
| 2007/0065164 | A1 | 3/2007 | Fujimori et al. |
| 2011/0091224 | A1 | 4/2011 | Takenaka |
| 2013/0236200 | A1 | 9/2013 | Tanaka et al. |

FOREIGN PATENT DOCUMENTS

| | | |
|---|---|---|
| JP | 9-006123 | 1/1997 |
| JP | 2007-079429 | 3/2007 |
| JP | 2008-039864 | 2/2008 |
| JP | 2010-015110 | 1/2010 |
| JP | 2010-039071 | 2/2010 |
| JP | 2011-090116 | 5/2011 |
| JP | 2011-150182 | 8/2011 |
| JP | 2012-058650 | 3/2012 |
| JP | 2013-218284 | 10/2013 |

*Primary Examiner* — Clayton E Laballe
*Assistant Examiner* — Jas Sanghera
(74) *Attorney, Agent, or Firm* — Harness, Dickey & Pierce, P.L.C.

(57) ABSTRACT

An image forming apparatus includes a developer bearer and a toner pattern bearer rotatable in a given direction of rotation to bear an adjustment toner pattern formed with the developer bearer. A toner pattern detector detects an amount of reflection light reflected by the adjustment toner pattern on the toner pattern bearer. A controller performs an adjustment mode to convert the detected amount of reflection light into a toner adhesion amount of toner of the adjustment toner pattern adhered to the toner pattern bearer. The controller forms an adhesion amount suppressing toner image on an upstream region on the toner pattern bearer that is upstream from the adjustment toner pattern in the direction of rotation of the toner pattern bearer. The upstream region is defined by a circumferential length of the developer bearer in the direction of rotation of the toner pattern bearer.

20 Claims, 12 Drawing Sheets

IMAGE FORMING APPARATUS AND IMAGE FORMING METHOD

CROSS-REFERENCE TO RELATED APPLICATION

This patent application is based on and claims priority pursuant to 35 U.S.C. §119 to Japanese Patent Application No. 2014-226387, filed on Nov. 6, 2014, in the Japanese Patent Office, the entire disclosure of which is hereby incorporated by reference herein.

BACKGROUND

1. Technical Field

Example embodiments generally relate to an image forming apparatus and an image forming method, and more particularly, to an image forming apparatus for forming a toner image on a recording medium and an image forming method performed by the image forming apparatus.

2. Background Art

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a developing device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such image forming apparatuses are susceptible to change in an image density of the toner image formed on the recording medium over time or as an environment such as a temperature and a humidity changes. To address this circumstance, an optical sensor detects the image density of a gradation toner pattern formed on the image bearer. A controller changes an image forming condition based on the detected image density to attain the constant image density. Such control is called a process control.

SUMMARY

At least one embodiment provides a novel image forming apparatus that includes a developer bearer to bear a developer to form an adjustment toner pattern. A toner pattern bearer is rotatable in a given direction of rotation to bear the adjustment toner pattern. A toner pattern detector emits light onto the adjustment toner pattern formed on the toner pattern bearer and detects an amount of reflection light reflected by the adjustment toner pattern. A controller performs an adjustment mode to convert the detected amount of reflection light into a toner adhesion amount of toner of the adjustment toner pattern adhered to the toner pattern bearer to change an image forming condition. The controller forms an adhesion amount suppressing toner image on a downstream region on the toner pattern bearer that is downstream from the adjustment toner pattern in the direction of rotation of the toner pattern bearer. The downstream region is defined by a circumferential length of the developer bearer in the direction of rotation of the toner pattern bearer.

At least one embodiment further provides a novel image forming apparatus that includes a developer bearer to bear a developer to form a first adjustment toner pattern and a second adjustment toner pattern. A toner pattern bearer is rotatable in a given direction of rotation to bear the first adjustment toner pattern on an image region thereon during off-printing and the second adjustment toner pattern on a non-image region outboard from the image region in a direction perpendicular to the direction of rotation of the toner pattern bearer during printing. A toner pattern detector emits light onto the first adjustment toner pattern and the second adjustment toner pattern formed on the toner pattern bearer and detects an amount of reflection light reflected by each of the first adjustment toner pattern and the second adjustment toner pattern. A controller performs a first adjustment mode to convert the detected amount of reflection light reflected by the first adjustment toner pattern into a toner adhesion amount of toner of the first adjustment toner pattern adhered to the toner pattern bearer to change an image forming condition. The controller performs a second adjustment mode to convert the detected amount of reflection light reflected by the second adjustment toner pattern into a toner adhesion amount of toner of the second adjustment toner pattern adhered to the toner pattern bearer to change the image forming condition. The controller forms the first adjustment toner pattern and the second adjustment toner pattern such that an image area rate of a first downstream region on the toner pattern bearer that is downstream from the first adjustment toner pattern and defined by at least a circumferential length of the developer bearer in the direction of rotation of the toner pattern bearer is identical to an image area rate of a second downstream region on the toner pattern bearer that is downstream from the second adjustment toner pattern and defined by at least the circumferential length of the developer bearer in the direction of rotation of the toner pattern bearer.

At least one embodiment provides a novel image forming method that includes determining a time to adjust an image forming condition; forming a first adjustment toner pattern on a toner pattern bearer; detecting a reflection light density of the first adjustment toner pattern with an optical sensor; obtaining a relation between the reflection light density and a developing bias; calculating a toner density, the developing bias, and a charging bias that achieve the obtained relation; setting the calculated toner density, the calculated developing bias, and the calculated charging bias; forming a plurality of dotted toner patches having different image area rates, respectively, on the toner pattern bearer; detecting the reflection light density of the plurality of dotted toner patches with the optical sensor; calculating an approximate based on a relation between the reflection light density and an output image signal from the optical sensor; determining the output image signal based on the calculated approximate; and determining a target image density.

Additional features and advantages of example embodiments will be more fully apparent from the following detailed description, the accompanying drawings, and the associated claims.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein.

Figure 1:
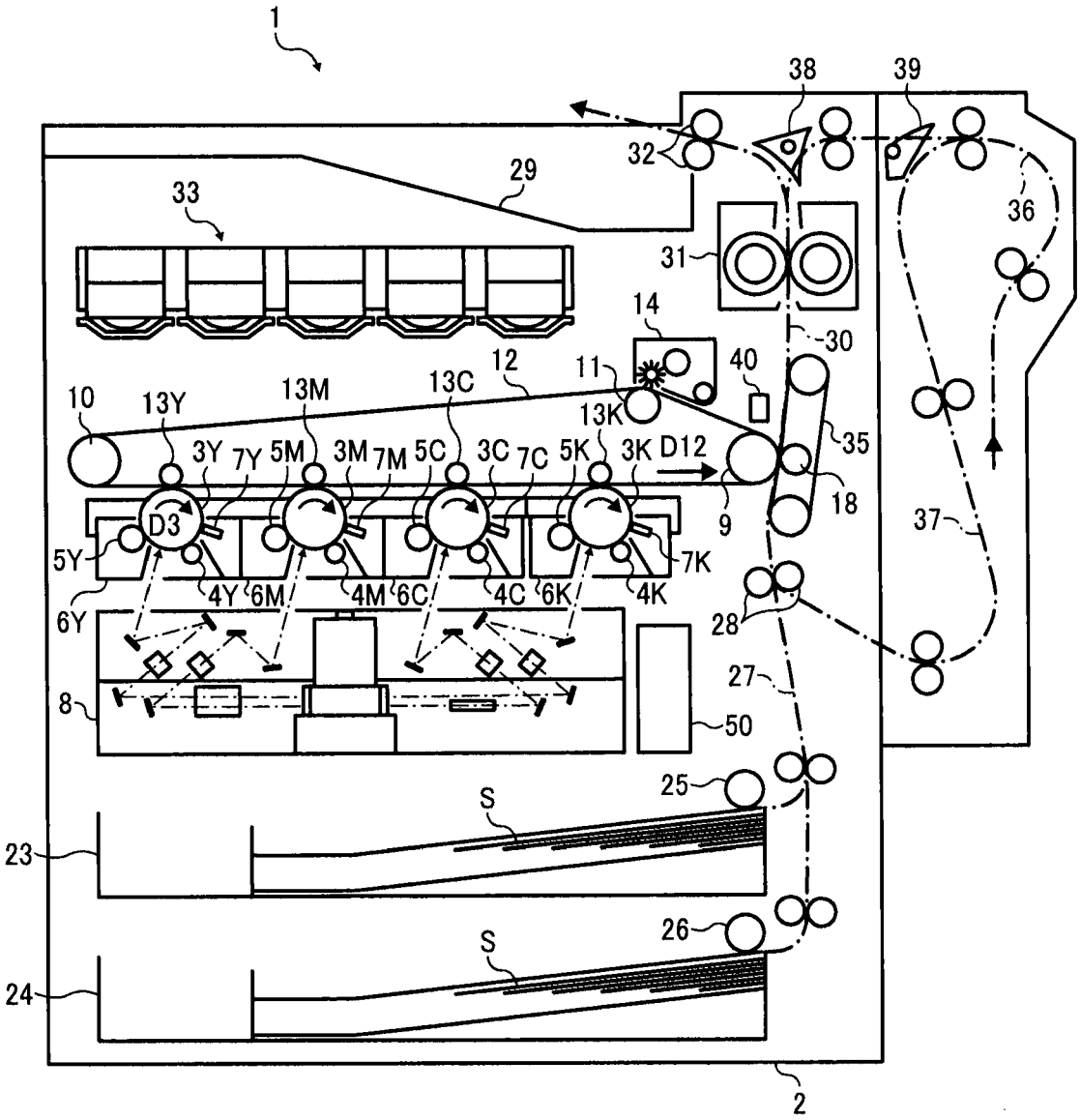
FIG. 1 is a schematic vertical sectional view of an image forming apparatus according to an example embodiment of the present disclosure.

The accompanying drawings are intended to depict example embodiments and should not be interpreted to limit the scope thereof. The accompanying drawings are not to be considered as drawn to scale unless explicitly noted.

DETAILED DESCRIPTION

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, a term such as "below" can encompass both an orientation of above and below. The device may be otherwise oriented (rotated 90 degrees or at other orientations) and the spatially relative descriptors used herein are interpreted accordingly.

Although the terms first, second, and the like may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present disclosure.

The terminology used herein is for the purpose of describing particular embodiments only and is not intended to be limiting of the present disclosure. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, particularly to FIG. 1, an image forming apparatus 1 according to an example embodiment is explained.

FIG. 1 is a schematic vertical sectional view of the image forming apparatus 1. The image forming apparatus 1 may be a copier, a facsimile machine, a printer, a multifunction peripheral or a multifunction printer (MFP) having at least one of copying, printing, scanning, facsimile, and plotter functions, or the like. According to this example embodiment, the image forming apparatus 1 is a color printer that forms color and monochrome toner images on recording media by electrophotography. Alternatively, the image forming apparatus 1 may be a monochrome printer that forms monochrome toner images.

With reference to FIG. 1, a description is provided of a construction of the image forming apparatus 1.

As shown in FIG. 1, the image forming apparatus 1 includes a body 2 accommodating four drum-shaped photoconductors 3Y, 3M, 3C, and 3K serving as image bearers situated at a substantially center portion of the body 2 and arranged horizontally in FIG. 1 with an identical interval between the adjacent photoconductors 3Y, 3M, 3C, and 3K. Suffixes Y, M, C, and K denote yellow, magenta, cyan, and black, respectively. The suffixes Y, M, C, and K are hereinafter omitted as needed.

A description is provided of a configuration of the photoconductor 3Y that forms a yellow toner image.

The photoconductor 3Y is constructed of an aluminum tube having a diameter in a range of from about 30 mm to about 100 mm, for example, and an organic semiconductor layer made of a photoconductive substance and coating an outer circumferential surface of the aluminum tube. The photoconductor 3Y is driven and rotated clockwise in FIG. 1 in a rotation direction D3. A lower part of the photoconductor 3Y is surrounded by a charging roller 4Y, a developing device 6Y, a cleaner 7Y, and the like that constitute an image forming device that forms a yellow toner image through electrophotographic processes. The charging roller 4Y, the developing device 6Y, the cleaner 7Y, and the like are arranged in this order in the rotation direction D3. The developing device 6Y includes a developing roller 5Y serving as a developer bearer. The developing roller 5Y is also called a developing sleeve. The charging roller 4Y, the developing device 6Y, the cleaner 7Y, and the like are accommodated in a single casing, constituting a process cartridge detachably attached to the body 2. The photoconductors 3M, 3C, and 3K that form toner images in different colors, that is, magenta, cyan, and black toner images, respectively, have a configuration identical to that of the photoconductor 3Y. Alternatively, each of the photoconductors 3Y, 3M, 3C, and 3K may be a belt type photoconductor.

A description is provided of a configuration of an exposure device 8.

The exposure device 8 is located below the process cartridges to form an electrostatic latent image on each of the photoconductors 3Y, 3M, 3C, and 3K. The exposure device 8 irradiates and scans an outer circumferential surface of the respective photoconductors 3Y, 3M, 3C, and 3K uniformly charged by the charging rollers 4Y, 4M, 4C, and 4K with laser beams according to yellow, magenta, cyan, and black image data, forming electrostatic latent images on the photoconductors 3Y, 3M, 3C, and 3K, respectively. An elongated space, that is, a slit, is provided between each of charging rollers 4Y, 4M, 4C, and 4K and each of developing rollers 5Y, 5M, 5C, and 5K so that the laser beam emitted from the exposure device 8 irradiates each of the photoconductors 3Y, 3M, 3C, and 3K through the slit. The exposure device 8 employs a laser scan method using a light source for emitting laser beams, a polygon mirror, and the like. Alternatively, the exposure device 8 may employ a combination method using a light-emitting diode (LED) array and an image forming system.

A description is provided of a configuration of an intermediate transfer belt 12.

The intermediate transfer belt 12 located above the photoconductors 3Y, 3M, 3C, and 3K serves as a toner pattern bearer supported by a plurality of rollers 9, 10, and 11. The intermediate transfer belt 12 is driven and rotated counterclockwise in FIG. 1 in a rotation direction D12. According to this example embodiment, the intermediate transfer belt 12 serves as a toner pattern bearer. Alternatively, the photoconductor 3 may serve as a toner pattern bearer if an optical sensor is configured to detect a toner pattern formed on the photoconductor 3 directly. Yet alternatively, if a toner image formed on the photoconductor 3 is transferred directly onto a sheet S serving as a recording medium while the sheet S is conveyed over the photoconductor 3 to form a toner pattern on the sheet S, the sheet S serves as a toner pattern bearer.

The intermediate transfer belt 12 is shared by the photoconductors 3Y, 3M, 3C, and 3K. The intermediate transfer belt 12 extends substantially horizontally and is planar with respect to the photoconductors 3Y, 3M, 3C, and 3K such that a portion of each of the photoconductors 3Y, 3M, 3C, and 3K comes into contact with the intermediate transfer belt 12 after a developing process in which the developing device 6 visualizes an electrostatic latent image as a toner image. Four primary transfer rollers 13Y, 13M, 13C, and 13K are in contact with an inner circumferential surface of the intermediate transfer belt 12 and disposed opposite the photoconductors 3Y, 3M, 3C, and 3K via the intermediate transfer belt 12, respectively. A belt cleaner 14 is in contact with an outer circumferential surface of the intermediate transfer belt 12 and disposed opposite the roller 11 via the intermediate transfer belt 12. The belt cleaner 14 removes residual toner failed to be transferred onto the sheet S and therefore remaining on the outer circumferential surface of the intermediate transfer belt 12 therefrom.

For example, the intermediate transfer belt 12 is a resin film or a belt including a rubber base layer. The base layer of the intermediate transfer belt 12 has a thickness in a range of from 50 micrometers to 600 micrometers and a resistance value great enough to transfer the toner image formed on each of the photoconductors 3Y, 3M, 3C, and 3K onto the intermediate transfer belt 12. The image forming devices constructed of the photoconductors 3Y, 3M, 3C, and 3K, the charging rollers 4Y, 4M, 4C, and 4K, developing devices 6Y, 6M, 6C, and 6K, cleaners 7Y, 7M, 7C, and 7K, and the exposure device 8 form yellow, magenta, cyan, and black toner images on the photoconductors 3Y, 3M, 3C, and 3K which are primarily transferred onto the intermediate transfer belt 12 by the primary transfer rollers 13Y, 13M, 13C, and 13K, respectively, such that the yellow, magenta, cyan, and black toner images are superimposed on a same position on the intermediate transfer belt 12.

A description is provided of a configuration of other components of the image forming apparatus 1.

Below the exposure device 8 inside the body 2 are a plurality of paper trays 23 and 24 serving as drawers removably attached to the body 2. According to this example embodiment, the two paper trays 23 and 24 are provided. Each of the paper trays 23 and 24 loads a plurality of sheets S. One of a plurality of feed rollers 25 and 26 is selectively actuated to feed a sheet S from the corresponding paper tray 23 or 24. The sheet S is conveyed through a conveyance path 27 substantially vertically toward a secondary transfer nip formed between the intermediate transfer belt 12 and a secondary transfer roller 18. Beside the intermediate transfer belt 12 is an endless conveyance belt 35. Inside a loop formed by the conveyance belt 35 is the secondary transfer roller 18 serving as a secondary transferor disposed opposite the roller 9, that is, one of the rollers 9, 10, and 11 that support the intermediate transfer belt 12. The secondary transfer roller 18 is pressed against the roller 9 via the conveyance belt 35 and the intermediate transfer belt 12, forming the secondary transfer nip between the conveyance belt 35 and the intermediate transfer belt 12.

The conveyance path 27 is provided with a registration roller pair 28 disposed immediately upstream from the secondary transfer nip in a sheet conveyance direction. The registration roller pair 28 conveys the sheet S to the secondary transfer nip at a proper time. Above the secondary transfer nip is an ejection path 30 contiguous to the conveyance path 27 and an output tray 29 disposed atop the body 2 to stack the sheet S. The ejection path 30 is further provided with a fixing device 31 including a fixing roller and a pressure roller, an output roller pair 32, and the like. A toner container holder 33 is located in a space inside the body 2 and below the output tray 29. The toner container holder 33 holds toner containers containing fresh yellow, magenta, cyan, and black toners to be used to visualize the electrostatic latent images formed on the photoconductors 3Y, 3M, 3C, and 3K, respectively. The fresh yellow, magenta, cyan, and black toners are supplied to the developing devices 6Y, 6M, 6C, and 6K through pumps or the like, respectively.

A description is provided of an image forming operation performed by the image forming apparatus 1 having the construction described above to form a toner image on a sheet S.

An image signal corresponding to a toner image to be formed on a sheet S is transmitted from a client computer, a scanner, a facsimile machine, or the like to a controller 50 incorporated in the image forming apparatus 1. The controller 50 converts the image signal into an appropriate output image signal determined by a control described below and sends the output image signal to the exposure device 8. A semiconductor laser of the exposure device 8 emits a laser beam onto the outer circumferential surface of the photoconductor 3Y uniformly charged by the charging roller 4Y according to yellow image data in an electrostatic latent image forming process, thus forming an electrostatic latent image on the photoconductor 3Y. The electrostatic latent image is subject to a developing process by the developing device 6Y, being visualized as a visible yellow toner image. The yellow toner image is subject to a primary transfer process by the primary transfer roller 13Y, being primarily transferred onto the intermediate transfer belt 12 that moves in synchronism with motion of the photoconductor 3Y.

Similarly, the electrostatic latent image forming process, the developing process, and the primary transfer process are also performed on the photoconductors 3M, 3C, and 3K successively at appropriate times, thus forming magenta, cyan, and black toner images on the intermediate transfer belt 12. Accordingly, the intermediate transfer belt 12 bears the yellow, magenta, cyan, and black toner images superimposed on the same position on the intermediate transfer belt 12 to form a full color toner image conveyed by the intermediate transfer belt 12. On the other hand, a sheet S is conveyed from one of the paper trays 23 and 24 to the registration roller pair 28 through the conveyance path 27. At a time when the full color toner image formed on the intermediate transfer belt 12 reaches the secondary transfer nip formed between the intermediate transfer belt 12 and the conveyance belt 35, the registration roller pair 28 conveys the sheet S to the secondary transfer nip where the secondary transfer roller 18 secondarily transfers the full color toner image formed on the intermediate transfer belt 12 onto the sheet S. The conveyance belt 35 conveys the sheet S bearing the full color toner image to the fixing device 31 that fixes the full color toner image on the sheet S in a fixing process. The output roller pair 32 ejects the sheet S onto the output tray 29.

If the image forming apparatus 1 receives a duplex print job, a switch claw 38 is moved to guide the sheet S bearing the fixed full color toner image to a reverse path 36 to reverse the sheet S. A switch claw 39 is moved to guide the reversed sheet S to the registration roller pair 28 through a re-feed path 37. Another toner image formed on the intermediate transfer belt 12 is secondarily transferred onto a back side, that is, a second side, of the sheet S. After the fixing device 31 fixes the toner image on the back side of the sheet S, the output roller pair 32 ejects the sheet S onto the output tray 29. The image forming operation of the image forming apparatus 1 is described above for a print job to form a full color toner image. Similarly, the image forming operation of the image forming apparatus 1 described above is performed for a print job to form a monochrome toner image in black or a specific color although at least one of the photoconductors 3Y, 3M, 3C, and 3K is not used.

A description is provided of a comparative control for adjusting an image density.

Under the comparative control, a toner pattern is formed on a non-image region on a transfer belt interposed between two sheets carried by the transfer belt during printing, that is, during an image forming operation. An optical sensor detects an adhesion amount of toner of the toner pattern adhered to the transfer belt. A controller maintains a constant image density based on the detected adhesion amount of toner. The controller determines an image forming condition under a process control during off-printing. The optical sensor detects a toner pattern equivalent to the toner pattern formed during printing. The controller sets the detected adhesion amount of toner as a target adhesion amount of toner.

When an electric potential of a charged photoconductor, a writing strength at which an exposure device writes an electrostatic latent image on the photoconductor, a developing bias, a toner density of a developer contained inside a developing device, and the like are constant, the adhesion amount of toner of the toner pattern should be constant. However, the adhesion amount of toner of the toner pattern may be changed by an image area rate of a preceding toner image formed on the transfer belt immediately before the toner pattern.

To address this circumstance, the controller may correct the adhesion amount of toner calculated based on a detection result of the optical sensor that detects the toner pattern according to the image area rate of a downstream region on the transfer belt that is downstream from the toner pattern and defined by a circumferential length of a developing sleeve in a rotation direction of the transfer belt. Accordingly, the controller decreases error in the adhesion amount of toner of the toner pattern caused by the preceding toner image.

However, if a gradation toner pattern formed during the process control is subject to influence from the preceding toner image, even if the controller corrects the adhesion amount of toner of the toner pattern during printing into an appropriate value, the image density may change because the target adhesion amount of toner used for correction is deviated. Additionally, even if the gradation toner pattern formed during the process control is not subject to influence from the preceding toner image, the image density may change. For example, the gradation toner pattern formed during the process control includes a plurality of toner patches having graded image densities, respectively. Accordingly, a downstream toner patch having a decreased image area rate serving as the preceding toner image may influence a downstream toner patch having an increased image area rate. Consequently, the downstream toner patch does not correspond to an image forming condition changing stepwise and therefore is subject to change in the image density.

Figure 2:
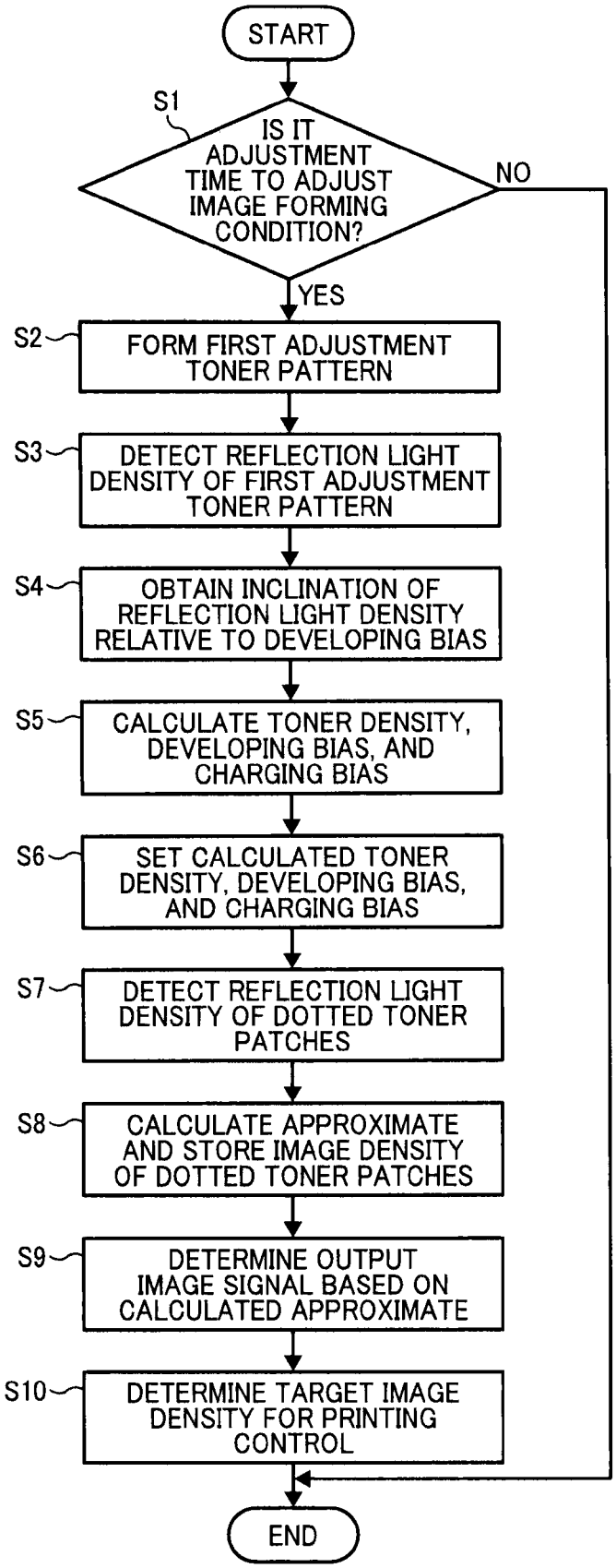
FIG. 2 is a flowchart showing control processes performed by a controller incorporated in the image forming apparatus shown in FIG. 1.

With reference to FIG. 2, a description is provided of control processes performed by the controller 50 incorporated in the image forming apparatus 1 depicted in FIG. 1 to control an image density of a toner image during off-printing (hereinafter referred to as an off-printing control).

FIG. 2 is a flowchart showing the control processes performed by the controller 50. Off-printing defines a time period when the image forming apparatus 1 does not form a toner image on a sheet S, such as a time period when the image forming apparatus 1 is warmed up after it is powered on and a time period when the photoconductor 3 is rotated idly before and after the image forming apparatus 1 forms a toner image on a sheet S. The off-printing control is performed in an adjustment mode.

Even if the image forming apparatus 1 corrects the image density by detecting the image density of the toner image once, the image density may fluctuate over time. For example, the image density is susceptible to fluctuation when the temperature and the humidity inside the image forming apparatus 1 change or the image forming apparatus 1 is not used for an extended period of time. Additionally, the image density is subject to fluctuation as the number of prints increases.

Figure 3:
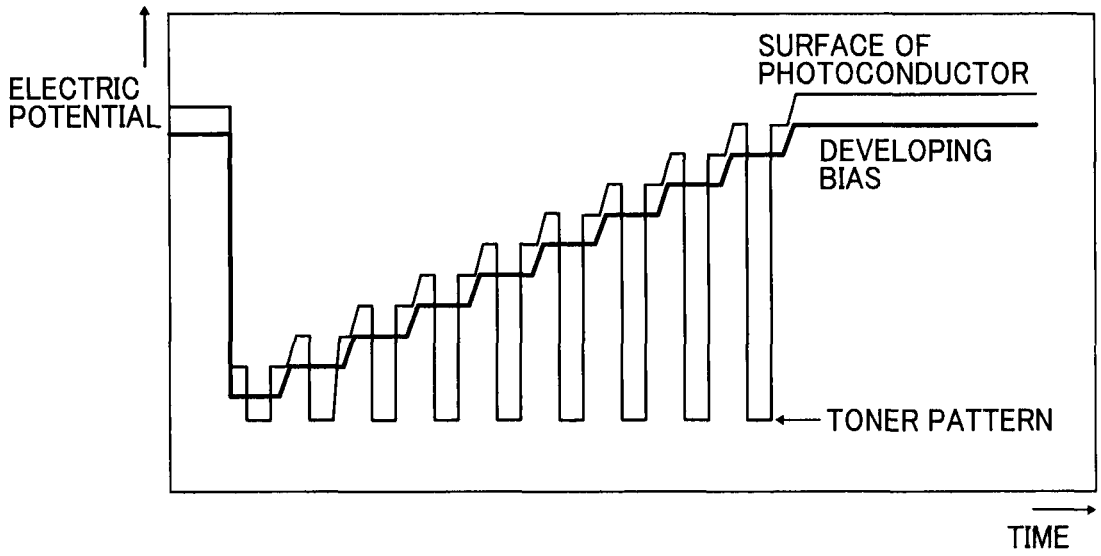
FIG. 3 is a graph showing a relation between the time and the electric potential of a photoconductor, a developing bias, and a toner pattern of the image forming apparatus shown in FIG. 1.
Figure 4:
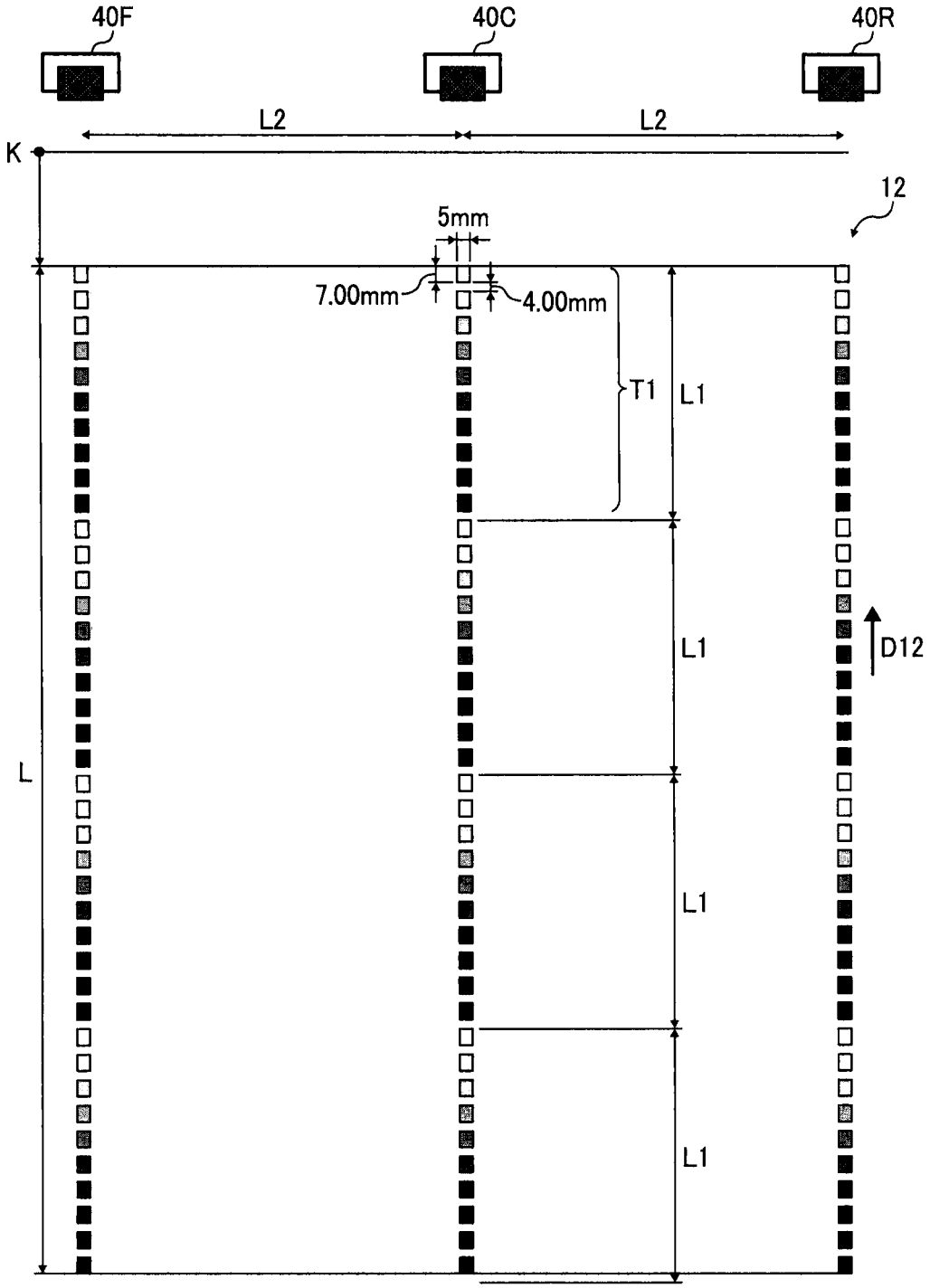
FIG. 4 is a plan view of a gradation toner pattern used in the control processes shown in FIG. 2.

To address this circumstance, a memory installed in the controller 50 stores, as an adjustment time to adjust an image forming condition, a time after the number of prints reaches a preset number of prints determined experimentally, a time when a temperature-humidity sensor installed inside the image forming apparatus 1 detects a change that reaches a threshold determined experimentally, a time when the image forming apparatus 1 is not used for an unused time determined experimentally or more, or the like. As shown in FIG. 2, in step S1, the controller 50 determines whether or not it is the adjustment time defined above according to a program stored in the controller 50. If the controller 50 determines that it is the adjustment time (YES in step S1), the controller 50 switches a charging bias of the charging roller 4 and a developing bias of the developing device 6 as shown in FIG. 3. The exposure device 8 exposes the photoconductor 3 with a laser beam under full lighting of the light source, thus forming a gradation toner pattern shown in FIG. 4 on the photoconductor 3. FIG. 3 is a graph showing a relation between the time and the electric potential of the photoconductor 3, the developing bias, and the toner pattern. FIG. 4 is a plan view of the gradation toner pattern.

The toner pattern defines the entire gradation toner pattern or each of toner patches constituting the gradation toner pattern. Under full lighting of the light source, the light source of the exposure device 8 continues exposing the photoconductor 3 with a laser beam in a region on the photoconductor 3 that is to bear the toner pattern as shown in FIG. 4 without creating dots on the toner pattern. Accordingly, the electric potential of the toner pattern formed on the photoconductor 3 after exposure is substantially constant as shown in FIG. 3.

As the controller 50 switches the developing bias for the toner pattern stepwise as shown in FIG. 3, the developing process is performed by increasing an amount of toner supplied to the photoconductor 3 as a difference in the electric potential between the toner pattern and the developing bias increases. Accordingly, as shown in FIG. 4, a toner pattern constructed of ten toner patches having different image densities, respectively, is formed on each photoconductor 3 as a first adjustment toner pattern T1 in step S2 depicted in FIG. 2. For example, three toner patterns are formed on three regions arranged in a main scanning direction in which the laser beam scans the photoconductor 3. The three regions include a front region, a center region, and a rear region that correspond to one lateral end region, a center region, and another lateral end region on the intermediate transfer belt 12 arranged in the main scanning direction. As shown in FIG. 4, four toner patterns, a black gradation toner pattern, a cyan gradation toner pattern, a magenta gradation toner pattern, and a yellow gradation toner pattern, are formed and aligned from a top to a bottom in FIG. 4 in the rotation direction D12 of the intermediate transfer belt 12. As the size of each toner patch of the toner pattern decreases, toner consumption decreases.

According to this example embodiment, each toner patch is rectangular with a width of 5 mm in the main scanning direction and a length of 7 mm in a sub-scanning direction perpendicular to the main scanning direction that is parallel to the rotation direction D12 of the intermediate transfer belt 12. The developing device 6 contains a two-component developer containing toner and carrier particles. If a difference between the charging bias and the developing bias increases excessively, the carrier particles may adhere to the photoconductor 3. To address this circumstance, the controller 50 switches the charging bias in synchronism with switch of the developing bias. An interval of 4 mm is provided between the adjacent toner patches in the sub-scanning direction. As shown in FIG. 4, a total length L of the black gradation toner pattern, the cyan gradation toner pattern, the magenta gradation toner pattern, and the yellow gradation toner pattern is 434 mm. A pitch L1 of each gradation toner pattern formed on the photoconductor 3 is 110 mm.

The primary transfer rollers 13Y, 13M, 13C, and 13K depicted in FIG. 1 primarily transfer the yellow, magenta, cyan, and black gradation toner patterns formed on the photoconductors 3Y, 3M, 3C, and 3K onto the intermediate transfer belt 12, respectively. Accordingly, as shown in FIG. 4, three gradation toner patterns, each of which is constructed of ten toner patches, are formed on the front region, the center region, and the rear region on the intermediate transfer belt 12 in the main scanning direction. Reflection type optical sensors, that is, a front optical sensor 40F, a center optical sensor 40C, and a rear optical sensor 40R, serving as a toner pattern detector disposed opposite the intermediate transfer belt 12 detect an amount of reflection light reflected by the three gradation toner patterns, respectively, in step S3 depicted in FIG. 2. The amount of reflection light defines a reflection light density. As shown in FIG. 4, the center optical sensor 40C serving as a first sensor is disposed opposite a center of the intermediate transfer belt 12 in the main scanning direction. The front optical sensor 40F serving as a second sensor is spaced apart from the center optical sensor 40C with a distance L2 therebetween in the main scanning direction. Similarly, the rear optical sensor 40R serving as a third sensor is spaced apart from the center optical sensor 40C with the distance L2 therebetween in the main scanning direction. The distance L2 is 160 mm. FIG. 4 illustrates a reference point K.

A detailed description is now given of a construction of each of the front optical sensor 40F, the center optical sensor 40C, and the rear optical sensor 40R.

Figure 5:
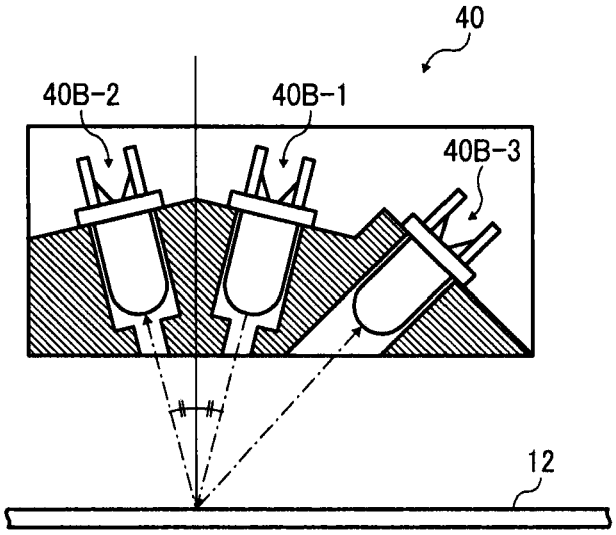
FIG. 5 is a sectional view of an optical sensor incorporated in the image forming apparatus shown in FIG. 1.

FIG. 5 is a sectional view of an optical sensor 40 representing each of the front optical sensor 40F, the center optical sensor 40C, and the rear optical sensor 40R depicted in FIG. 4. As shown in FIG. 5, the optical sensor 40 includes a light-emitting element 40B-1, a specular reflection light-receiving element 40B-2, and a diffuse reflection light-receiving element 40B-3, for example. Light emitted by the light-emitting element 40B-1 is reflected by the intermediate transfer belt 12. The specular reflection light-receiving element 40B-2 detects specular reflection light. The diffuse reflection light-receiving element 40B-3 detects diffuse reflection light.

Figure 6:
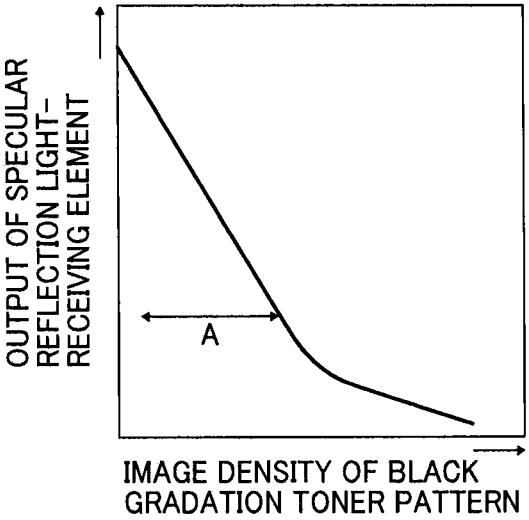
FIG. 6 is a graph showing a relation between the image density of a black gradation toner pattern of the gradation toner pattern shown in FIG. 4 and the output of a specular reflection light-receiving element of the optical sensor shown in FIG. 5.

FIG. 6 is a graph showing a relation between the image density of the black gradation toner pattern and the output of the specular reflection light-receiving element 40B-2. As an amount of black toner of the black gradation toner pattern increases, an amount of specular reflection light reflected by the intermediate transfer belt 12 decreases. Accordingly, the controller 50 performs the image density control with the specular reflection light-receiving element 40B-2.

Figure 7:
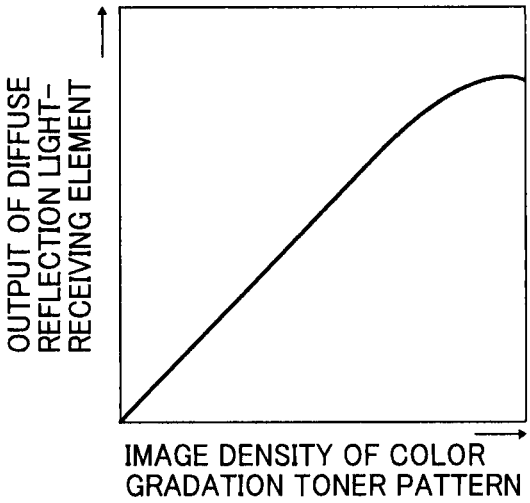
FIG. 7 is a graph showing a relation between the image density of a color gradation toner pattern of the gradation toner pattern shown in FIG. 4 and the output of a diffuse reflection light-receiving element of the optical sensor shown in FIG. 5.

FIG. 7 is a graph showing a relation between the image density of a color gradation toner pattern (e.g., the yellow, magenta, and cyan gradation toner patterns) and the output of the diffuse reflection light-receiving element 40B-3. As an amount of color toner of the color gradation toner pattern increases, an amount of diffuse reflection light reflected by the intermediate transfer belt 12 increases. Accordingly, the controller 50 performs the image density control with the diffuse reflection light-receiving element 40B-3.

Figure 8:
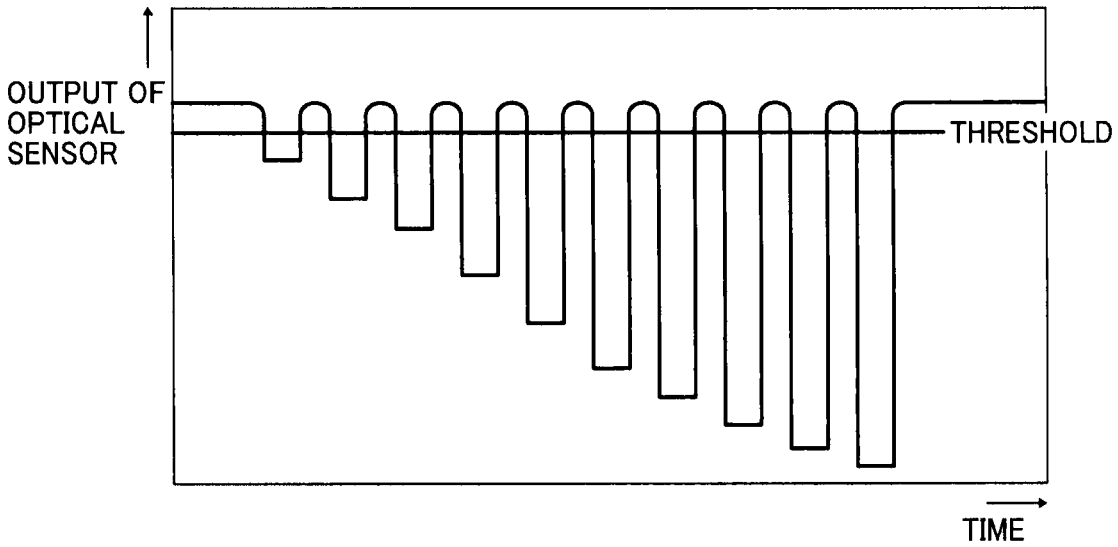
FIG. 8 is a graph showing a relation between the time and the output of the optical sensor shown in FIG. 5 for the black gradation toner pattern constructed of a plurality of toner patches.

FIG. 8 is a graph showing a relation between the time and the output of the optical sensor 40 for the black gradation toner pattern constructed of a plurality of toner patches, for example, ten toner patches. As the black gradation toner pattern moves immediately under the optical sensor 40 in accordance with rotation of the intermediate transfer belt 12, the output of the optical sensor 40 changes over time according to the image density of the black gradation toner pattern.

A threshold for distinguishing the black gradation toner pattern from a background on the intermediate transfer belt 12 that does not bear the black gradation toner pattern is set with respect to the output of the optical sensor 40. Based on a trigger defining an output of the optical sensor 40 lower than the threshold, the controller 50 identifies an output of the optical sensor 40 that corresponds to the position or the image density of the black gradation toner pattern. Based on a trigger defining a time when the exposure device 8 writes an electrostatic latent image to be formed into a first toner pattern on one of the four photoconductors 3Y, 3M, 3C, and 3K, the controller 50 estimates a time when the toner pattern reaches a position on the intermediate transfer belt 21 immediately under the optical sensor 40 based on a layout of parts of each component of the image forming apparatus 1 and the process linear velocity of the photoconductors 3Y, 3M, 3C, and 3K and the intermediate transfer belt 12. Hence, the optical sensor 40 may detect the toner pattern at the estimated time. However, it is necessary to increase the size of the toner patch in view of detection error.

To address this circumstance, the light-emitting element 40B-1 starts emitting light earlier than a time when the toner pattern reaches the position on the intermediate transfer belt 12 immediately under the optical sensor 40 by a given time and the controller 50 conducts data sampling successively to identify the toner pattern by using the threshold. Accordingly, the image forming apparatus 1 forms the toner patch having a decreased size compared to formation of the toner patch by determining a time of exposure by the exposure device 8 and a time of detection of the toner pattern based on the layout of the photoconductors 3Y, 3M, 3C, and 3K and the intermediate transfer belt 12. As the size of each toner patch of the toner pattern decreases, toner consumption decreases by an amount of the decrease. It is also preferable to decrease the detection area of the optical sensor 40 so as to decrease the size of the toner patch.

According to this example embodiment, the detection area of the optical sensor 40 is a circle having a diameter of 1 mm by downsizing of the light-emitting element 40B-1, the specular reflection light-receiving element 40B-2, and the diffuse reflection light-receiving element 40B-3, incorporation of a slit or the like, and the like. It is preferable that the detection area of the optical sensor 40 is not greater than 2 mm. According to this example embodiment, as shown in FIG. 4, each toner patch has the length of 7 mm in the sub-scanning direction. Alternatively, the length of each toner patch may be about 5 mm in the sub-scanning direction in view of the number of data sampling, the accuracy in detecting an edge of each toner patch, or the like. Thus, it is preferable that each toner patch has the length in a range of from 5 mm to 7 mm in the sub-scanning direction.

The controller 50 determines the reflection light density of each toner patch based on the output from the optical sensor 40 in step S3 depicted in FIG. 2. In a graph defined by a horizontal X axis representing the developing bias and a vertical Y axis representing the reflection light density, data for the reflection light density of the ten toner patches are plotted with respect to the developing bias and approximated into a straight line having an inclination γ in step S4 depicted in FIG. 2. The inclination γ represents a developing capacity of each of the developing devices 6Y, 6M, 6C, and 6K. The inclination γ is adjusted by changing the toner density of the developer contained in the developing device 6. The toner density of the developer defines an amount of toner relative to carrier particles contained in the developer accommodated inside the developing device 6. If the inclination γ is greater than a target value, the controller 50 decreases the toner density of the developer to approximate the inclination γ to the target value. Conversely, if the inclination γ is smaller than the target value, the controller 50 increases the toner density of the developer to approximate the inclination γ to the target value.

Even without changing the inclination γ, the controller 50 may change the developing bias to adjust a maximum image density of the toner pattern. If the controller 50 increases an absolute value of the developing bias, an amount of toner used in the developing process increases and the reflection light density of the toner pattern having the maximum image density increases. Conversely, if the controller 50 decreases the absolute value of the developing bias, the reflection light density of the toner pattern decreases.

When changing the developing bias, it is necessary to change the charging bias in accordance with change in the developing bias and maintain a constant difference between the electric potential of a non-developing region on the photoconductor 3 where development is not conducted and the developing bias. According to this example embodiment, if the inclination γ is in a given range, the controller 50 changes the developing bias and the charging bias to obtain a target maximum reflection light density. Conversely, if the inclination γ is not in the given range, the controller 50 changes a target control value of the toner density of the developer to adjust the inclination γ in the given range. The amount of change in the developing bias and the charging bias is readily obtained based on a value determined experimentally and a detection result provided by the optical sensor 40 in step S5 depicted in FIG. 2.

A relation between the inclination γ and the toner density is preset experimentally and the controller 50 calculates the toner density to be changed based on the preset relation and the detected inclination γ in step S5 depicted in FIG. 2. A toner density sensor detects the toner density of the developer contained in the developing device 6. The controller 50 supplies fresh toner to the developing device 6 based on an output from the toner density sensor to obtain a target toner density. When the controller 50 determines the toner density to be changed, the controller 50 changes the target control value of the toner density sensor, thus setting the toner density in step S6 depicted in FIG. 2. Simultaneously, the controller 50 sets the developing bias and the charging bias in step S6 depicted in FIG. 2. Thus, the controller 50 corrects change in the toner density of the developer contained in the developing device 6 which may occur over time under change in an environment through the control processes described above.

A description is provided of a dotted toner pattern formed on the intermediate transfer belt 12.

Figure 9:
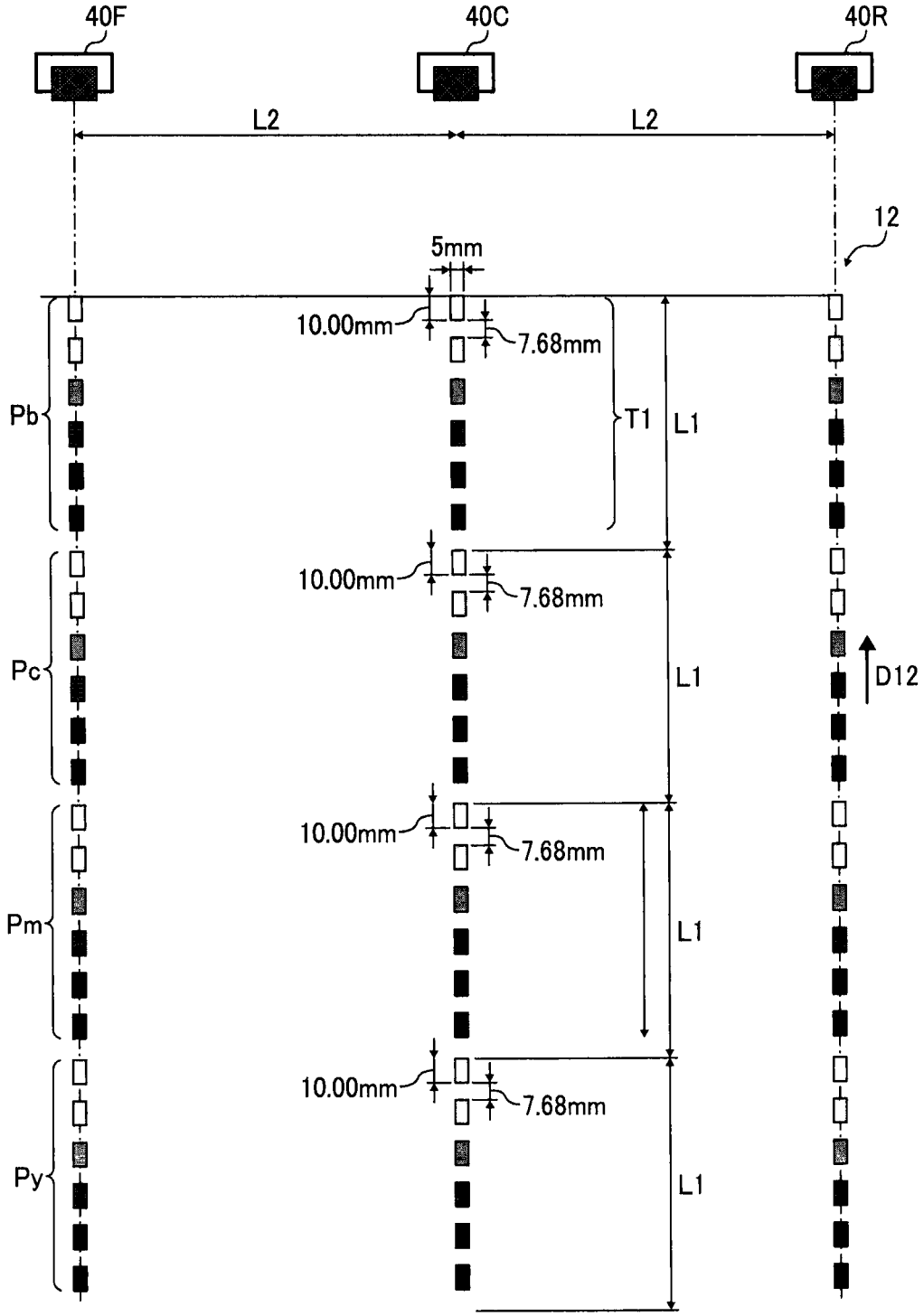
FIG. 9 is a plan view of an intermediate transfer belt incorporated in the image forming apparatus shown in FIG. 1 illustrating a dotted toner pattern formed thereon.
Figure 10:
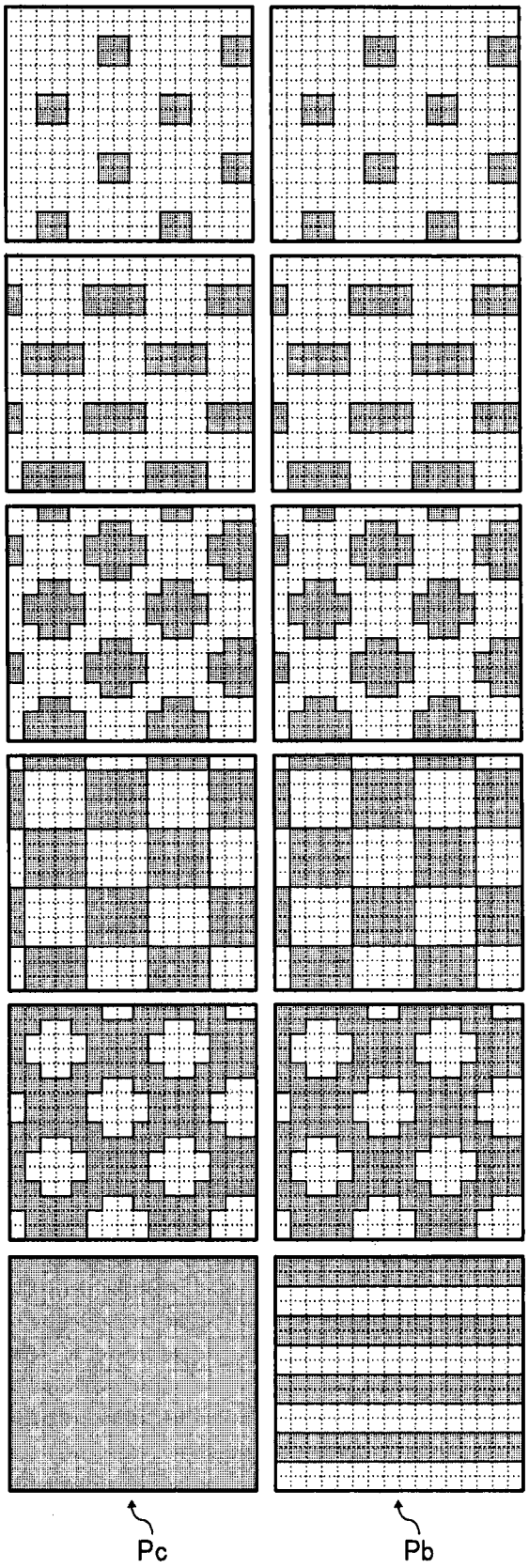
FIG. 10 is a plan view of the dotted toner pattern shown in FIG. 9 illustrating variation in the image area rate.

FIG. 9 is a plan view of the intermediate transfer belt 12 illustrating the dotted toner pattern serving as the first adjustment toner pattern T1. The dotted toner pattern depicted in FIG. 9 is constructed of dotted toner patches having various image area rates as shown in FIG. 10. FIG. 10 is a plan view of the dotted toner pattern illustrating variation in the image area rate. As shown in FIG. 10, the dotted toner pattern includes a cyan areal gradation toner pattern Pc and a black areal gradation toner pattern Pb. As shown in FIG. 9, the black areal gradation toner pattern Pb, the cyan areal gradation toner pattern Pc, a magenta areal gradation toner pattern Pm, and a yellow areal gradation toner pattern Py are aligned from a top to a bottom in FIG. 9 in the rotation direction D12 of the intermediate transfer belt 12. The digital image forming apparatus 1 defines an intermediate image density by a rate of dots per unit area, that is, an image area rate. The image area rate is changed to attain a decreased image density, the intermediate image density, and an increased image density.

Even if the exposure device 8 exposes the photoconductor 3 under full lighting of the light source as described above, the intermediate image density of the dotted toner patch may vary due to change in sensitivity of the photoconductor 3 or the like. To correct variation in the intermediate image density of the dotted toner patch, a plurality of dotted toner patches having different image area rates, respectively, is formed on the intermediate transfer belt 12 under a charging bias, a developing bias, and an exposure condition that are identical to those used to form a regular toner image. The optical sensor 40 detects the plurality of dotted toner patches in step S7 depicted in FIG. 2. Two methods are available to change the image area rate: a first method to scatter dots of a decreased size and increase a number of dots gradually and a second method to concentrate dots and increase the size of the concentrated dots gradually. According to this example embodiment, the second method is employed. The second method achieves stability against noise such as jitter.

FIG. 10 illustrates the cyan areal gradation toner pattern Pc including first to sixth dotted toner patches aligned vertically from a top to a bottom on the left and the black areal gradation toner pattern Pb including first to sixth dotted toner patches aligned vertically from the top to the bottom on the right. The size of dots in each of the cyan areal gradation toner pattern Pc and the black areal gradation toner pattern Pb increases from the top to the bottom in FIG. 10. For example, the image area rate of the cyan areal gradation toner pattern Pc is 12.5 percent in the first dotted toner patch, 25.0 percent in the second dotted toner patch, 37.5 percent in the third dotted toner patch, 50.0 percent in the fourth dotted toner patch, 62.5 percent in the fifth dotted toner patch, and the 100 percent in the sixth dotted toner patch. The image area rate of the black areal gradation toner pattern Pb is 12.5 percent in the first dotted toner patch, 25.0 percent in the second dotted toner patch, 37.5 percent in the third dotted toner patch, 50.0 percent in the fourth dotted toner patch, 62.5 percent in the fifth dotted toner patch, and 50.0 percent in the sixth dotted toner patch. The dotted toner pattern having various image area rates corresponds to the output image signal.

The controller 50 calculates the reflection light density of the dotted toner pattern and the approximate by referring to a graph defined by the horizontal X axis representing the output image signal and the vertical Y axis representing the reflection light density of the dotted toner pattern in step S8 depicted in FIG. 2. Simultaneously, the controller 50 stores the image density of a toner patch of the black areal gradation toner pattern Pb that has the image area rate of 50 percent and the image density of a toner patch of each of the yellow areal gradation toner pattern Py, the magenta areal gradation toner pattern Pm, and the cyan areal gradation toner pattern Pc, that has the image area rate of 100 percent in step S8 depicted in FIG. 2. The controller 50 calculates the image area rate of dots defining the output image signal needed to output the reflection light density requested by an input signal sent from the client computer or the like based on the calculated approximate in step S9 depicted in FIG. 2. Thus, the controller 50 determines the output image signal needed to output the reflection light density requested by the input signal based on the input signal in step S9 depicted in FIG. 2.

The controller 50 determines a target image density for a printing control performed while the image forming apparatus 1 forms a toner image on a sheet S in step S10 depicted in FIG. 2. In the printing control described below, a target image density X of the toner pattern under the printing control is determined as below.

The dotted toner pattern having the various image area rates as shown in FIG. 10 that is formed under the toner density, the developing bias, and the charging bias determined in step S6 includes a toner pattern used under the printing control. An average in the detected image density of the dotted toner patterns situated in both lateral ends of the intermediate transfer belt 12 in the axial direction thereof during off-printing defines the target image density X. For example, the dotted toner patterns are detected by the front optical sensor 40F and the rear optical sensor 40R depicted in FIG. 9, respectively, and include the black toner patch having the image area rate of 50 percent and the color toner patch having the image area rate of 100 percent that are stored in the controller 50 in step S8 depicted in FIG. 2.

Instead of calculation of the average as described above, outputs from the optical sensor 40 that detects a plurality of dotted toner patterns having different image area rates, respectively, may be approximated into a straight line to determine the target image density X.

Figure 11:
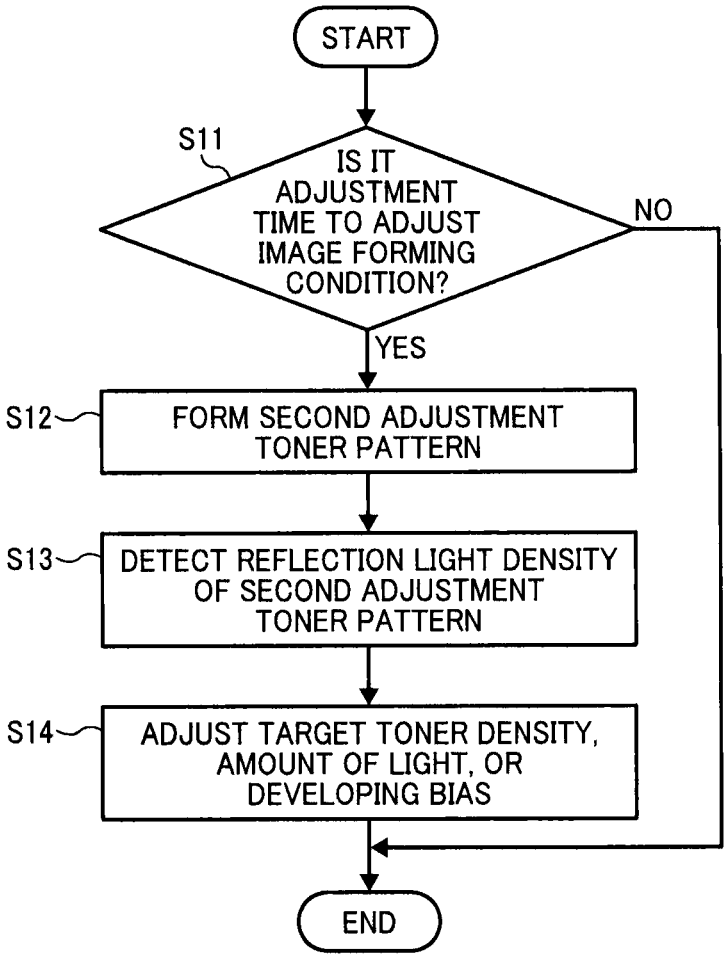
FIG. 11 is a flowchart showing control processes performed by the controller incorporated in the image forming apparatus shown in FIG. 1 during printing.
Figure 12:
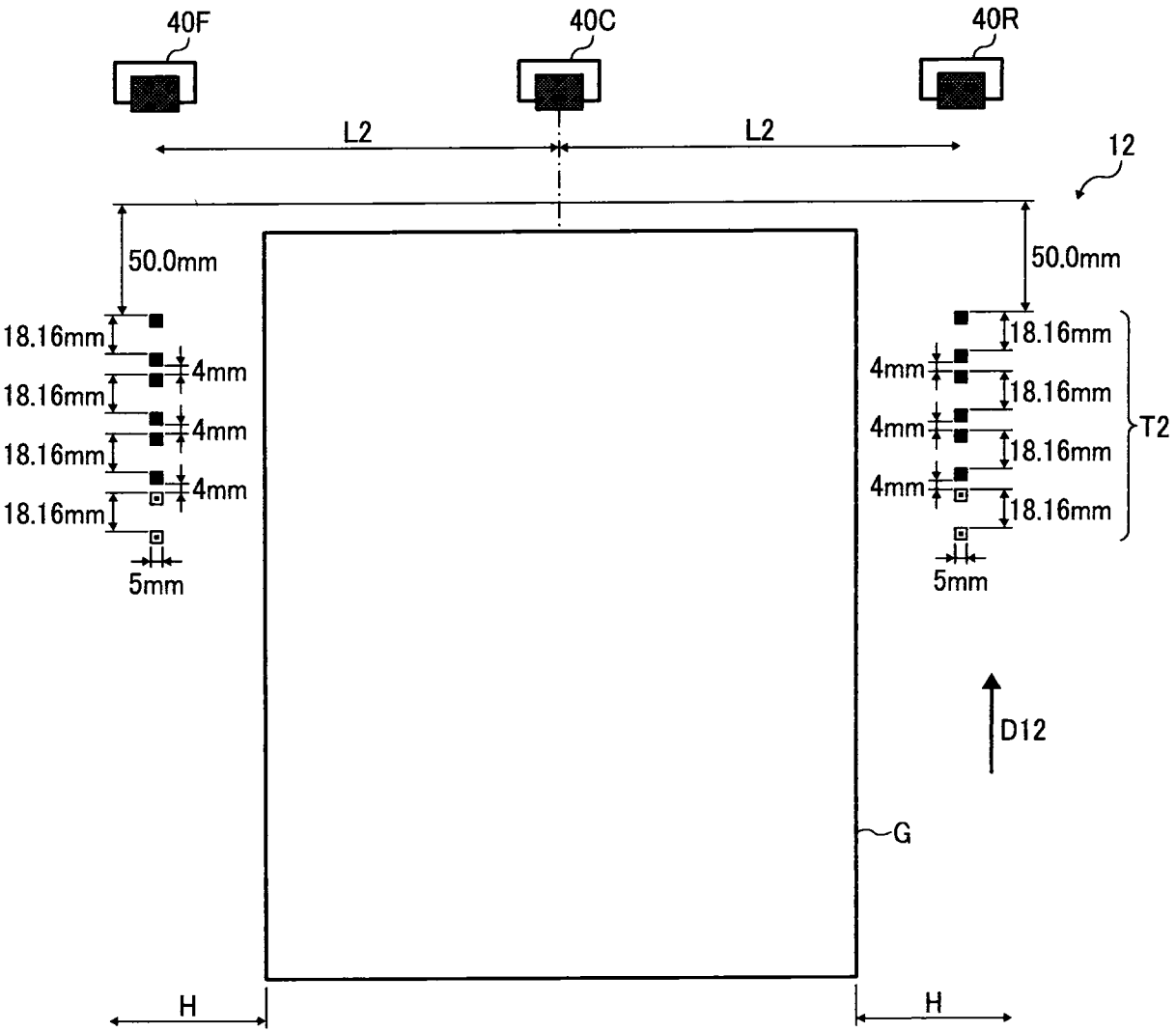
FIG. 12 is a plan view of the intermediate transfer belt shown in FIG. 9 illustrating a toner pattern formed at each lateral end on the intermediate transfer belt in an axial direction thereof.

With reference to FIGS. 11 and 12, a description is provided of control processes performed by the controller 50 to control the image density of a toner image during printing (hereinafter referred to as the printing control).

FIG. 11 is a flowchart showing the control processes performed by the controller 50 during printing. Printing defines the image forming operation described above performed by the image forming apparatus 1 to form the toner image on the sheet S. The printing control is performed in a second adjustment mode.

The optical sensor 40 may detect the toner pattern constantly during printing. However, substantial change in the image density rarely occurs. Further, it is desirable to save toner. To address this circumstance, the controller 50 may form the toner pattern whenever a given number of prints is output, whenever a given operation time of the image forming apparatus 1 elapses, or whenever the photoconductor 3 or the developing roller 5 rotates for a given distance, which are determined experimentally, so as to perform the image density control.

As shown in FIG. 11, in step S11, the controller 50 determines whether it is the adjustment time to adjust the image forming condition defined above under the printing control. If the controller 50 determines that it is the adjustment time to adjust the image forming condition (YES in step S11), the controller 50 forms a toner pattern serving as a second adjustment toner pattern T2 on a non-image region H disposed at each lateral end of the intermediate transfer belt 12 in the main scanning direction in addition to a toner image formed on an image region G at the center of the intermediate transfer belt 12 in the main scanning direction in step S12 depicted in FIG. 11 as shown in FIG. 12. FIG. 12 is a plan view of the intermediate transfer belt 12 illustrating the toner pattern formed at each lateral end on the intermediate transfer belt 12 in the axial direction thereof. The toner pattern shown in FIG. 12 includes a plurality of toner patches that is smaller in the number than the toner patches formed under the off-printing control and is selected in advance from the toner patches constituting the toner pattern serving as the first adjustment toner pattern T1 formed under the off-printing control. That is, the toner pattern shown in FIG. 12 is identical to the toner pattern for which the target image density X is calculated in the flowchart showing the off-printing control in FIG. 2. Usage of the identical toner pattern renders it easy to maintain the condition of the image forming apparatus 1 immediately after the developing bias and the like are adjusted under the off-printing control than usage of a different toner pattern.

A lowermost black toner patch of the toner pattern shown in FIG. 12 has the intermediate image density. For example, the lowermost black toner patch is a dotted toner patch having the image area rate of 50 percent. The dotted toner patch having the image area rate of 50 percent is used because a black dotted patch having an increased image density (e.g., a reflection light density) decreases change in output of the optical sensor 40 with respect to change in the image density, resulting in decrease in sensitivity as shown in the graph depicted in FIG. 6 showing output of the specular reflection light-receiving element 40B-2 with respect to the image density of the black gradation toner pattern. Accordingly, it is preferable to set the image density of the toner pattern under the printing control in a span A defining the intermediate image density where change in output of the specular reflection light-receiving element 40B-2 of the optical sensor 40 is substantial with respect to change in the image density of the toner pattern as shown in FIG. 6. The span A has the image area rate not greater than about 70 percent. Additionally, in order to compensate for a maximum image density, the greater the image density, the better. Accordingly, a lower limit of the image density of the toner pattern is 30 percent.

The toner pattern formed on the intermediate transfer belt 12 moves under the front optical sensor 40F and the rear optical sensor 40R which detect the reflection light density of light reflected by the toner pattern in step S13 depicted in FIG. 11. Data sampling is conducted in a method substantially identical to the method described above that is used to detect the toner pattern formed under full lighting of the light source. For example, based on the time when the exposure device 8 writes an electrostatic latent image to be formed into a first toner patch on one of the four photoconductors 3Y, 3M, 3C, and 3K, the controller 50 estimates the time when the toner patch reaches a position on the intermediate transfer belt 21 immediately under the optical sensor 40 based on the layout of parts of each component of the image forming apparatus 1 and the process linear velocity of the photoconductors 3Y, 3M, 3C, and 3K and the intermediate transfer belt 12. The light-emitting element 40B-1 is turned on slightly earlier than the estimated time. Based on an output of the optical sensor 40 lower than the preset threshold, the controller 50 identifies an output of the optical sensor 40 that corresponds to the position or the image density of the toner patch.

According to this example embodiment, as shown in FIG. 12, the controller 50 calculates an average image density of two identical dotted toner patches. The controller 50 compares the reflection light density determined based on the output from the optical sensor 40 with the target image density X determined under the preceding off-printing control and adjusts one of the target toner density, the amount of light that exposes the photoconductor 3, and the developing bias in step S14 depicted in FIG. 11. If the reflection light density is lower than the target image density X, the controller 50 increases the target control value of the toner density, the amount of light, or the absolute value of the developing bias. Conversely, if the reflection light density is higher than the target image density X, the controller 50 decreases the target control value of the toner density, the amount of light, or the absolute value of the developing bias. The amount of change is determined experimentally for each image forming apparatus 1.

Since it is possible to increase and decrease the amount of light that exposes the photoconductor 3 to write an electrostatic latent image relatively quickly than the toner density, the controller 50 according to this example embodiment adjusts the amount of light.

As described above, according to this example embodiment, during off-printing, the controller 50 forms the plurality of toner patches serving as the first adjustment toner pattern T1 to set the image forming condition precisely. During printing, the controller 50 forms a decreased number of toner patches serving as the second adjustment toner pattern T2 while the image forming apparatus 1 forms a toner image on a sheet S so that the optical sensor 40 detects the toner patches. The controller 50 performs the image density control during printing while maintaining the condition of the image forming apparatus 1 that is identical to the condition during off-printing. Accordingly, the controller 50 maintains stability in quality of the toner image formed on the sheet S for an extended period of time compared to when the controller 50 performs the image density control during off-printing only. Additionally, the controller 50 performs the image density control more precisely compared to when the controller 50 performs the image density control during printing only.

Figure 13:
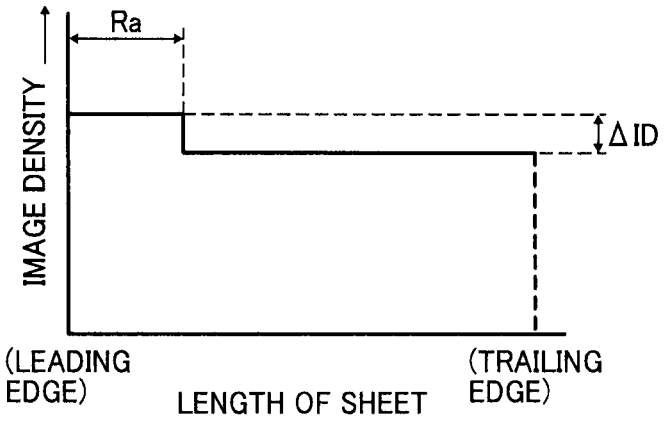
FIG. 13 is a graph showing a relation between the length of a sheet in a circumferential direction of a developing sleeve incorporated in the image forming apparatus shown in FIG. 1 and the image density.

FIG. 13 is a graph showing a relation between the length of the sheet S in a circumferential direction of the developing sleeve (e.g., the developing roller 5) and the image density. The graph depicted in FIG. 13 shows a result of measurement for measuring the image density changing from a leading edge of a solid toner image to a trailing edge of the solid toner image when the solid toner image is formed on a sheet S immediately after no toner image is formed on a preceding sheet S. FIG. 13 shows the length of the sheet S in the circumferential direction or a rotation direction of the developing sleeve. As shown in FIG. 13, the image density in a given span of the solid toner image in the circumferential direction of the developing sleeve, that is, a circumferential length Ra of the developing sleeve, which is defined from the leading edge of the solid toner image is different from the image density in other span of the solid toner image. For example, the image density in the given span of the solid toner image defined from the leading edge of the solid toner image is greater than the image density in other span of the solid toner image. An image density difference ΔID between the image density of the given span of the solid toner image and the image density of other span of the solid toner image is about 0.1.

When a plurality of toner images in a plurality of colors is layered, for example, when two solid toner images are layered to form a color toner image, the image density difference ΔID may be distinguished. The given span corresponds to the single circumferential length Ra of the developing sleeve. Even if toner adhered to the developing sleeve is charged at a polarity identical to a polarity of the developing bias and therefore the developing bias is not applied to the developing sleeve, when the developing sleeve is adhered with toner, the controller 50 may determine that the developing bias is applied to an outer circumferential surface of the developing sleeve.

Figure 14:
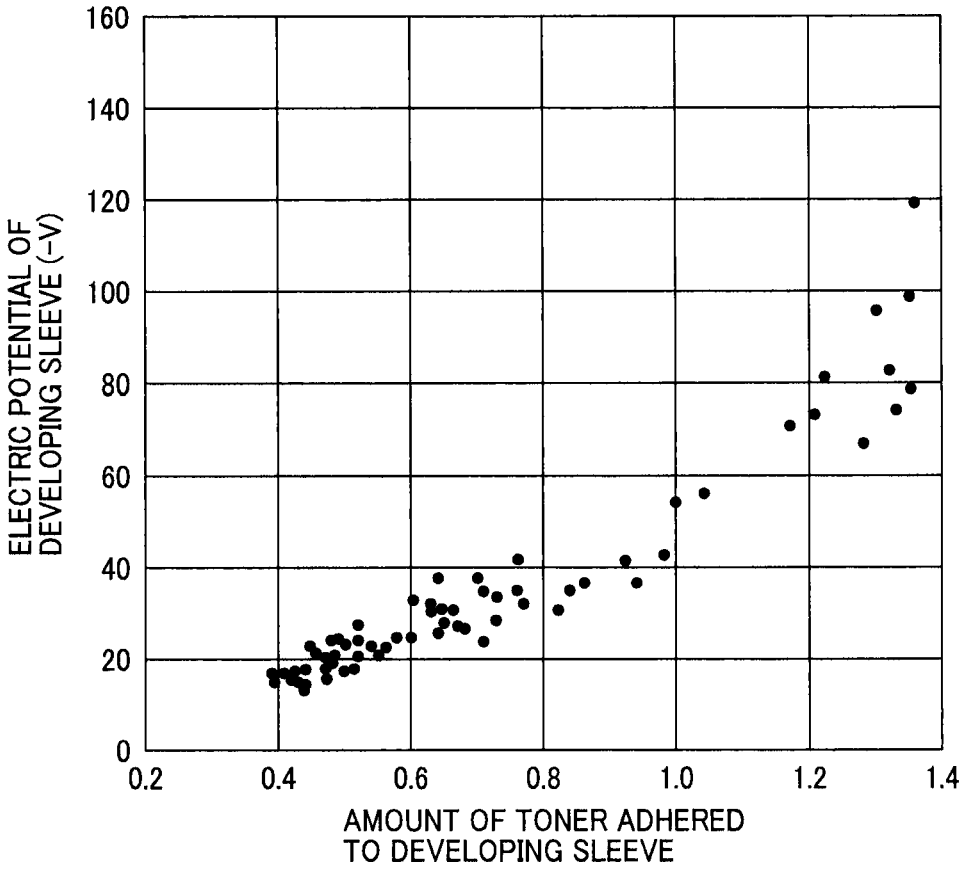
FIG. 14 is a graph showing a relation between the amount of toner adhered or fixed to the developing sleeve and the electric potential of an outer circumferential surface of the developing sleeve.

FIG. 14 is a graph showing a relation between the amount of toner adhered or fixed to the developing sleeve and the electric potential of the outer circumferential surface of the developing sleeve. The amount of toner adhered to the developing sleeve defines a toner density of toner adhered to the outer circumferential surface of the developing sleeve when toner is adhered to the typical developing sleeve. The toner density of toner adhered to the outer circumferential surface of the developing sleeve is measured with a reflection light densitometer when carrier particles are separated from the developing sleeve after formation of a solid toner image. No bias voltage is applied to the developing sleeve when measuring the toner density.

As shown in FIG. 14, when a decreased amount of toner is adhered to the developing sleeve, a decreased electric potential of the developing sleeve is measured. Conversely, when an increased amount of toner is adhered and fixed to the developing sleeve, an increased electric potential of the developing sleeve is measured. As the amount of toner adhered or fixed to the developing sleeve increases, the electric potential of the outer circumferential surface of the developing sleeve also increases.

For example, the electric potential of the outer circumferential surface of the developing sleeve increases as shown in FIG. 14. Increase and decrease in the amount of toner adhered or fixed to the developing sleeve are similar to increase and decrease in the image area rate of a preceding toner image. As shown in FIGS. 13 and 14, the image density is influenced by the image area rate of the preceding toner image.

For example, if the preceding toner image has a decreased image area rate and an increased amount of toner remains on the developing sleeve after formation of the preceding toner image, the toner remaining on the developing sleeve increases an effective bias of the developing sleeve. Accordingly, the image density of a subsequent toner image increases in a span of the subsequent toner image that corresponds to at least the single circumferential length Ra of the developing sleeve.

For example, as shown in FIG. 13, a solid toner image having an increased image density for a length of the solid toner image that corresponds to the single circumferential length Ra of the developing sleeve from the leading edge of the solid toner image is developed when an increased amount of toner is adhered to the outer circumferential surface of the developing sleeve after no toner image is formed on a preceding sheet S and the increased effective bias increases an amount of toner used for development. Thereafter, as development of the solid toner image is conducted while the developing sleeve rotates for a first rotation, most of toner adhered to the developing sleeve may separate from the developing sleeve electrostatically through development of the solid toner image. Accordingly, the effective developing bias during a second rotation of the developing sleeve decreases to a level of the developing bias practically applied to the developing sleeve. Consequently, the amount of toner used for development during and after the second rotation of the developing sleeve is smaller than that during the first rotation of the developing sleeve, causing the image density difference.

Such phenomenon also occurs during a process control. As described above, the controller 50 determines the target image density for the printing control in step S10 depicted in FIG. 2. If the amount of toner of the toner pattern changes according to the image area rate immediately before formation of the toner pattern, the target image density for the printing control may deviate. Accordingly, the image density during printing may deviate from an appropriate range.

For example, if the image area rate of a preceding toner image before a reference toner image is relatively small and a position of the reference toner image formed on the intermediate transfer belt 12 is separated from a position of the preceding toner image formed on the intermediate transfer belt 12 by the circumferential length Ra of the developing sleeve or smaller, an amount of toner of the reference toner image detected by the optical sensor 40 is greater than a precise amount of toner that should be detected by the optical sensor 40. Accordingly, the process control may be performed based on a decreased image density smaller than an appropriate image density.

To address this circumstance, according to this example embodiment, when forming a toner pattern used under the printing control and when forming a toner pattern used to determine a target adhesion amount of toner adhered to the intermediate transfer belt 12 under the process control during off-printing, the controller 50 causes the image area rate of a first downstream region on the intermediate transfer belt 12 that is downstream from the toner pattern used to determine the adhesion amount of toner during off-printing and defined by at least the circumferential length Ra of the developing sleeve in the rotation direction D12 of the intermediate transfer belt 12 to be identical to an image area rate of a second downstream region on the intermediate transfer belt 12 that is downstream from the toner pattern used under the printing control and defined by at least the circumferential length Ra of the developing sleeve in the rotation direction D12 of the intermediate transfer belt 12. For example, when forming the first adjustment toner pattern T1 under the process control during off-printing and when forming the second adjustment toner pattern T2 used under the printing control, the controller 50 prevents the image density of the first adjustment toner pattern T1 and the second adjustment toner pattern T2 from being susceptible to influence from the image density of the preceding toner image disposed downstream from the first adjustment toner pattern T1 and the second adjustment toner pattern T2 in the rotation direction D12 of the intermediate transfer belt 12.

According to this example embodiment, as shown in FIG. 12, no toner image is formed on the intermediate transfer belt 12 immediately before the toner pattern, that is, the second adjustment toner pattern T2, formed during printing on the non-image region H disposed at each lateral end of the intermediate transfer belt 12 in the main scanning direction. Accordingly, the second downstream region on the intermediate transfer belt 12 that is disposed downstream from the second adjustment toner pattern T2 and defined by the circumferential length Ra of the developing sleeve in the rotation direction D12 of the intermediate transfer belt 12 attains the image area rate of zero.

As shown in FIG. 13, if the toner image immediately before the second adjustment toner pattern T2 has a decreased image area rate, the adhesion amount of toner of the second adjustment toner pattern T2 adhered to the intermediate transfer belt 12 may increase. Hence, the adhesion amount of toner of the second adjustment toner pattern T2 adhered to the intermediate transfer belt 12 during printing may increase whenever printing is conducted.

A downstream toner patch to determine a target adhesion amount of toner of the toner pattern may be positioned in a downstream part of a set of gradation toner patches in the rotation direction D12 of the intermediate transfer belt 12. In this case, a downstream toner patch situated in a downstream part of the set of gradation toner patches in the rotation direction D12 of the intermediate transfer belt 12 and having a decreased image density is situated in the first downstream region on the intermediate transfer belt 12 that is downstream from an upstream toner patch and defined by the circumferential length Ra of the developing sleeve in the rotation direction D12 of the intermediate transfer belt 12. The first downstream region defined by the circumferential length Ra of the developing sleeve corresponds to a time interval between formation of the upstream toner patch on the photoconductor 3 and formation of the downstream toner patch on the photoconductor 3.

Accordingly, the target adhesion amount of toner of the toner pattern adhered to the intermediate transfer belt 12 is set to a decreased level shown in FIG. 13. Consequently, the target adhesion amount of toner of the toner pattern adhered to the intermediate transfer belt 12 decreases. Conversely, the adhesion amount of toner of the toner pattern adhered to the intermediate transfer belt 12 during printing increases. To address this circumstance, the controller 50 changes the image forming condition (e.g., the toner density, the developing bias, and power supplied to a laser diode (LD) of the exposure device 8) to decrease the adhesion amount of toner of the toner pattern adhered to the intermediate transfer belt 12. As a result, the image density decreases gradually. The controller 50 adjusts the image density to an appropriate value again during a subsequent process control. However, the controller 50 decreases the image density repeatedly during printing. Accordingly, the image density may change repeatedly.

Figure 15:
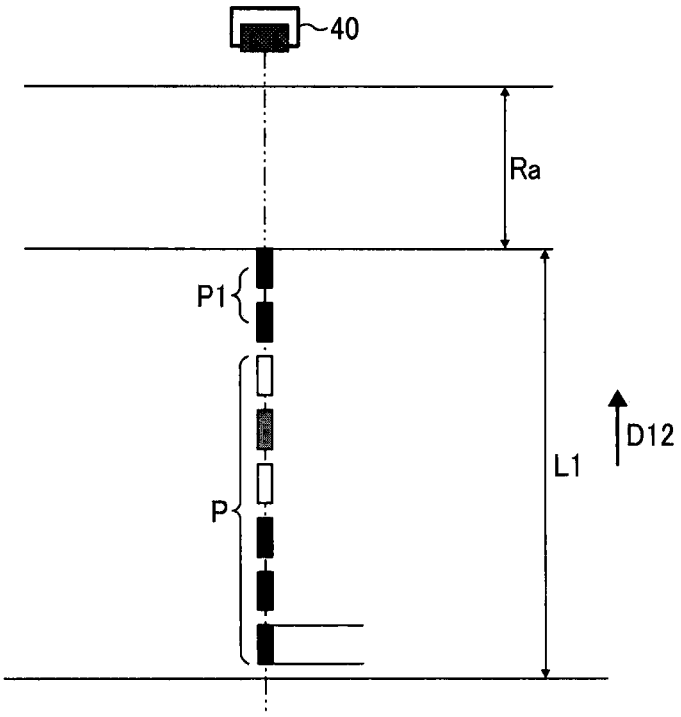
FIG. 15 is a plan view of a toner pattern formed on the intermediate transfer belt shown in FIG. 9 illustrating a layout thereof.

To address this circumstance, the image forming apparatus 1 forms a toner pattern serving as the first adjustment toner pattern T1 as shown in FIG. 15. FIG. 15 is a plan view of the toner pattern serving as the first adjustment toner pattern T1 illustrating a layout thereof. The image forming apparatus 1 forms a toner pattern P1 serving as a third toner pattern used to determine the target adhesion amount of toner adhered to the intermediate transfer belt 12. The toner pattern P1 has an image area rate identical to that of the toner pattern formed during printing, that is, the second adjustment toner pattern T2. The toner pattern P1 is disposed downstream from an areal gradation toner pattern P used for image processing in the rotation direction D12 of the intermediate transfer belt 12. No toner pattern is formed in the first downstream region on the intermediate transfer belt 12 that is downstream from the toner pattern P1 and defined by the circumferential length Ra of the developing sleeve in the rotation direction D12 of the intermediate transfer belt 12.

Since no toner image is formed on the intermediate transfer belt 12 immediately before the second adjustment toner pattern T2 is formed during printing, the controller 50 addresses to a condition in which the image area rate of the second downstream region on the intermediate transfer belt 12 that is disposed downstream from the second adjustment toner pattern T2 and defined by the circumferential length Ra of the developing sleeve in the rotation direction D12 of the intermediate transfer belt 12 is zero. Accordingly, the target adhesion amount of toner increases also when the controller 50 determines the target adhesion amount of toner in view of the principle described above by referring to FIG. 13. For example, the adhesion amount of toner of the toner pattern P1 to determine the target adhesion amount of toner increases.

Under the printing control to adjust the image density by forming the second adjustment toner pattern T2 during printing, it is sufficient for the controller 50 to maintain the image density under the process control. Accordingly, if the adhesion amount of toner increases when determining the target adhesion amount of toner and when printing, no difference in the image density occurs. Accordingly, the controller 50 does not induce decrease or increase of the image density, maintaining an appropriate image density.

According to this example embodiment, since the adhesion amount of toner does not deviate due to the image area rate immediately before formation of the toner pattern P, the controller 50 maintains the image density immediately after the process control to be free from repeated change. Under the process control, no toner image is formed on the first -downstream region on the intermediate transfer belt 12 that is disposed downstream from the first adjustment toner pattern T1 and defined by the circumferential length Ra of the developing sleeve in the rotation direction D12 of the intermediate transfer belt 12. Accordingly, the first adjustment toner pattern T1 and the second adjustment toner pattern T2 are formed under an identical toner pattern forming condition when forming the first adjustment toner pattern T1 during off-printing and when forming the second adjustment toner pattern T2 during printing to determine the target adhesion amount of toner.

A description is provided of a second example embodiment of the control performed by the controller 50.

According to the second example embodiment, the controller 50 forms a toner pattern immediately before the toner pattern formed during printing. As described above, since the adhesion amount of toner of the toner pattern varies depending on the image area rate immediately before the toner pattern, a toner pattern serving as a fourth toner pattern is formed before the second adjustment toner pattern T2 formed during printing to cause the image area rate of the fourth toner pattern to be identical to the image area rate of the first downstream region on the intermediate transfer belt 12 that is downstream from the first adjustment toner pattern T1 and defined by the circumferential length Ra of the developing sleeve to determine the target adhesion amount of toner under the process control. Accordingly, the controller 50 prevents increase in the adhesion amount of toner of the second adjustment toner pattern T2 adhered to the intermediate transfer belt 12 during printing, thus eliminating the difference between the target adhesion amount of toner and the adhesion amount of toner of the second adjustment toner pattern T2 during printing and maintaining the appropriate image density. The toner pattern formed immediately before the second adjustment toner pattern T2 formed during printing is an adhesion amount suppressing toner image.

Figure 16:
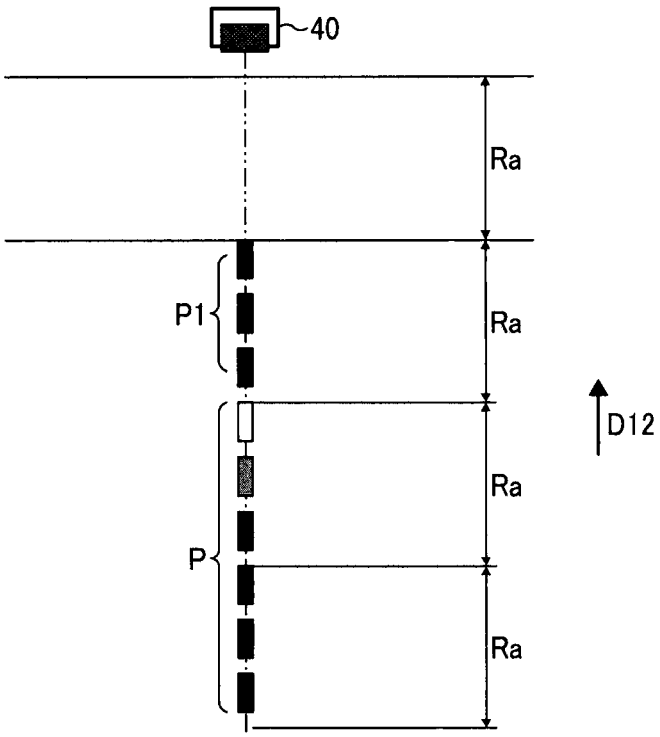
FIG. 16 is a plan view of a toner pattern formed on the intermediate transfer belt shown in FIG. 9 illustrating another layout thereof.

With reference to FIG. 16, a description is provided of a third example embodiment of the control performed by the controller 50.

As shown in FIG. 9, the controller 50 forms a toner pattern constructed of a plurality of toner patches, that is, a plurality of areal degradation toner patches, having different image area rates, respectively, for correction in image processing. If the adhesion amount of toner of the toner pattern used for image processing, that is, the first adjustment toner pattern T1, changes according to the image area rate of the first downstream region downstream from the first adjustment toner pattern T1 in the rotation direction D12 of the intermediate transfer belt 12, the controller 50 may not perform correction in image processing appropriately. For example, when forming the first adjustment toner pattern T1 constructed of the toner patches having different image area rates, respectively, if the image area rate of the first -downstream region on the intermediate transfer belt 12 that is -downstream from the first adjustment toner pattern T1 and defined by the circumferential length Ra of the developing sleeve in the rotation direction D12 of the intermediate transfer belt 12 is zero, the adhesion amount of toner of the first adjustment toner pattern T1 increases. Accordingly, the adhesion amount of toner of the first adjustment toner pattern T1 calculated based on a detection result of the optical sensor 40 increases relative to the input image area rate. Consequently, the input image area rate is decreased for feedback to an image processor.

However, the target image density may be lower than a target value because a toner image formed on the intermediate transfer belt 12 may not be adhered with toner in an increased adhesion amount. To address this circumstance, it is necessary to form the first adjustment toner pattern T1 used for feedback to the image processor without adverse effect from the image area rate of the first downstream region on the intermediate transfer belt 12.

If the adhesion amount suppressing toner pattern is formed on a region immediately downstream from the first adjustment toner pattern T1 used for image processing in the rotation direction D12 of the intermediate transfer belt 12, that is, the first downstream region defined by the circumferential length Ra of the intermediate transfer belt 12, to increase the image area rate, influence of the increased adhesion amount of toner is eliminated. However, formation of the toner pattern not directed to control may increase toner consumption and increase an adjustment time by a time taken to form the toner pattern.

To address this circumstance, according to this example embodiment, as shown in FIG. 16, the controller 50 forms the toner pattern P1 used to determine the target adhesion amount of toner during printing. The controller 50 further forms the areal gradation toner pattern P used for image processing and constructed of a plurality of toner patches having graded image area rates, respectively. FIG. 16 is a plan view of the toner pattern P1 and the areal gradation toner pattern P. The areal gradation toner pattern P is disposed in a downstream region downstream from a head of the toner pattern P1 by the circumferential length Ra of the developing sleeve in the rotation direction D12 of the intermediate transfer belt 12 in a third adjustment mode. Like the toner pattern P1 shown in FIG. 15, no toner pattern is formed on the intermediate transfer belt 12 in the first downstream region on the intermediate transfer belt 12 that is -downstream from the leading toner pattern P1 and defined by the circumferential length Ra of the developing sleeve in the rotation direction D12 of the intermediate transfer belt 12 so that the image area rate of the first -downstream region is zero.

The toner pattern P1 disposed immediately downstream from the areal gradation toner pattern P used for feedback to the image processor prevents decrease in the adhesion amount of toner. The toner pattern P1 is susceptible to influence of the image area rate of zero of the first downstream region on the intermediate transfer belt 12 that is downstream from the toner pattern P1 and defined by the circumferential length Ra of the developing sleeve in the rotation direction D12 of the intermediate transfer belt 12. Conversely, the areal gradation toner pattern P is immune from such influence. Additionally, it is not necessary to form a toner pattern directed solely to prevent increase in the adhesion amount of toner, preventing increase in toner consumption and the adjustment time. The toner pattern P1 is an adhesion amount suppressing toner image.

As shown in FIG. 16, the circumferential length Ra of the developing sleeve is greater than a length of each toner patch of the toner pattern P1 in the rotation direction D12 of the intermediate transfer belt 12. Accordingly, a plurality of identical toner patches is formed to calculate the target adhesion amount of toner by averaging detection data obtained from the toner patches. If the toner pattern P1 used to calculate the target adhesion amount of toner is constructed of a single toner patch, there may be no toner patch disposed in an upstream region on the intermediate transfer belt 12 that is upstream from a second toner patch and a third toner patch of the areal gradation toner pattern P used for image processing and defined by the circumferential length Ra of the developing sleeve in the rotation direction D12 of the intermediate transfer belt 12, resulting in increase in the adhesion amount of toner. To address this circumstance, the toner pattern P1 used to calculate the target adhesion amount of toner is constructed of a plurality of toner patches, for example, three toner patches according to this example embodiment, so that there is a toner patch disposed in the downstream region on the intermediate transfer belt 12 that is -downstream from the areal gradation toner pattern P and defined by the circumferential length Ra of the developing sleeve in the rotation direction D12 of the intermediate transfer belt 12. Accordingly, the controller 50 prevents increase in the adhesion amount of toner with respect to the second toner patch and the third toner patch of the areal gradation toner pattern P used for image processing.

According to the example embodiments described above, when forming the first adjustment toner pattern T1 used under the process control during off-printing and when forming the second adjustment toner pattern T2 used under the printing control, the controller 50 prevents the image density from being susceptible to influence of the image area rate of the first -downstream region and the second -downstream region on the intermediate transfer belt 12 that are downstream from the first adjustment toner pattern T1 and the second adjustment toner pattern T2, respectively, in the rotation direction D12 of the intermediate transfer belt 12. However, the present disclosure is not limited to the example embodiments described above. For example, even if the image density is adjusted solely with the process control during off-printing, the controller 50 may form the adhesion amount suppressing toner image such as a toner pattern in the downstream part of the areal gradation toner pattern P that is constructed of a plurality of graded toner patches having decreased image densities, respectively, thus suppressing change in the image density of the graded toner patches and enhancing accuracy in the target image density. Similarly, the image density may be adjusted by forming a toner pattern in the non-image region H depicted in FIG. 12 on the intermediate transfer belt 12 during printing.

A description is provided of advantages of the image forming apparatus 1.

As shown in FIG. 1, the image forming apparatus 1 includes an image bearer (e.g., the photoconductors 3Y, 3M, 3C, and 3K), a developing device (e.g., the developing devices 6Y, 6M, 6C, and 6K) including a developer bearer (e.g., the developing rollers 5Y, 5M, 5C, and 5K), a toner pattern bearer (e.g., the intermediate transfer belt 12), a toner pattern detector (e.g., the optical sensor 40), and a controller (e.g., the controller 50). The image bearer bears an electrostatic latent image. The developer bearer, as it rotates, supplies toner to the electrostatic latent image formed on the image bearer to develop the electrostatic latent image into a toner image. The toner pattern bearer bears an adjustment toner pattern as it rotates in a given direction of rotation (e.g., the rotation direction D12). The toner pattern detector emits light onto the adjustment toner pattern formed on the toner pattern bearer and detects reflection light reflected by the adjustment toner pattern.

The controller performs an adjustment mode to change an image forming condition to obtain an appropriate toner adhesion amount of toner of the adjustment toner pattern by forming the adjustment toner pattern on the toner pattern bearer during printing or off-printing, detecting an amount of reflection light reflected by the adjustment toner pattern with the toner pattern detector, and converting the detected amount of reflection light into the adhesion amount of toner of the adjustment toner pattern. When the controller forms the adjustment toner pattern, the controller forms an adhesion amount suppressing toner image on a downstream region on the toner pattern bearer that is downstream from the adjustment toner pattern and defined by the circumferential length Ra of the developer bearer in the direction of rotation of the toner pattern bearer so as to suppress increase in the adhesion amount of toner of the adjustment toner pattern caused by a decreased image area rate of the downstream region on the toner pattern bearer.

Alternatively, as shown in FIG. 1, the image forming apparatus 1 includes an image bearer (e.g., the photoconductors 3Y, 3M, 3C, and 3K), a developing device (e.g., the developing devices 6Y, 6M, 6C, and 6K) including a developer bearer (e.g., the developing rollers 5Y, 5M, 5C, and 5K), a toner pattern bearer (e.g., the intermediate transfer belt 12), a toner pattern detector (e.g., the optical sensor 40), and a controller (e.g., the controller 50). The image bearer bears an electrostatic latent image. The developer bearer, as it rotates, supplies toner to the electrostatic latent image formed on the image bearer to develop the electrostatic latent image into a toner image. The toner pattern bearer bears a first adjustment toner pattern and a second adjustment toner pattern as it rotates in a given direction of rotation (e.g., the rotation direction D12). The toner pattern detector emits light onto the first adjustment toner pattern and the second adjustment toner pattern formed on the toner pattern bearer and detects reflection light reflected by the first adjustment toner pattern and the second adjustment toner pattern.

The controller performs a first adjustment mode to change an image forming condition to obtain an appropriate toner adhesion amount of toner of the first adjustment toner pattern adhered to the toner pattern bearer by forming the first adjustment toner pattern on the toner pattern bearer during off-printing, detecting an amount of reflection light reflected by the first adjustment toner pattern with the toner pattern detector, and converting the detected amount of reflection light into the adhesion amount of toner of the first adjustment toner pattern. The controller performs a second adjustment mode to change the image forming condition to obtain an appropriate toner adhesion amount of toner of the second adjustment toner pattern adhered to the toner pattern bearer by forming the second adjustment toner pattern on the non-image region H on the toner pattern bearer during printing, detecting an amount of reflection light reflected by the second adjustment toner pattern with the toner pattern detector, and converting the detected amount of reflection light into the adhesion amount of toner of the second adjustment toner pattern.

The controller forms the first adjustment toner pattern and the second adjustment toner pattern such that an image area rate of a first downstream region on the toner pattern bearer that is downstream from the first adjustment toner pattern and defined by at least the circumferential length Ra of the developer bearer in the direction of rotation of the toner pattern bearer is identical to an image area rate of a second downstream region on the toner pattern bearer that is downstream from the second adjustment toner pattern and defined by at least the circumferential length Ra of the developer bearer in the direction of rotation of the toner pattern bearer.

Accordingly, the image forming apparatus 1 suppresses change in the image density caused by a preceding toner image immediately downstream from the adjustment toner pattern in the direction of rotation of the toner pattern bearer, achieving an even image density and improving quality of a toner image formed on a recording medium.

The present disclosure is not limited to the details of the example embodiments described above and various modifications and improvements are possible. The advantages achieved by the image forming apparatus 1 are not limited to those described above.

The present disclosure has been described above with reference to specific example embodiments. Note that the present disclosure is not limited to the details of the embodiments described above, but various modifications and enhancements are possible without departing from the spirit and scope of the disclosure. It is therefore to be understood that the present disclosure may be practiced otherwise than as specifically described herein. For example, elements and/or features of different illustrative example embodiments may be combined with each other and/or substituted for each other within the scope of the present disclosure.

What is claimed is:

1. An image forming apparatus comprising:

a developer bearer configured to, bear a developer, and form an adjustment toner pattern on a toner pattern bearer;

the toner pattern bearer configured to, rotate in a direction of rotation, and bear the adjustment toner pattern;

a toner pattern detector configured to, emit light onto the adjustment toner pattern, and detect an amount of reflection light reflected by the adjustment toner pattern; and a controller configured to, convert the detected amount of reflection light into a toner adhesion amount of the adjustment toner pattern to change an image forming condition when in an adjustment mode, form an adhesion amount suppressing toner image on a downstream region of the toner pattern bearer, the adhesion amount suppressing toner image being downstream from the adjustment toner pattern during rotation of the toner pattern bearer, the downstream region being a circumferential length of the developer bearer during rotation of the toner pattern bearer.

2. The image forming apparatus according to claim 1, wherein the adhesion amount suppressing toner image includes the adjustment toner pattern.

3. The image forming apparatus according to claim 1, wherein the controller is further configured to decrease an error in the toner adhesion amount based on a detection result obtained by the toner pattern detector, the toner pattern detector is configured to detect the adhesion amount suppressing toner image on the downstream region.

4. An image forming apparatus comprising:

a developer bearer configured to, bear a developer, form a first adjustment toner pattern on a toner pattern bearer, and form a second adjustment toner pattern on the toner pattern bearer;

the toner pattern bearer configured to, rotate in a direction of rotation, bear the first adjustment toner pattern on an image region of the toner pattern bearer during an off-printing period, and bear the second adjustment toner pattern on a non-image region of the toner pattern bearer during a printing period, the non-image region being outboard from the image region in a direction perpendicular during rotation of the toner pattern bearer;

a toner pattern detector configured to, emit light onto the first adjustment toner pattern, emit light onto the second adjustment toner pattern, detect a first amount of reflection light reflected by the first adjustment toner pattern, and detect a second amount of reflection of light reflected by the second adjustment toner pattern; and a controller configured to, convert the detected first amount of reflection light reflected by the first adjustment toner pattern into a first toner adhesion amount of the first adjustment toner pattern to change an image forming condition when in a first adjustment mode, convert the detected second amount of reflection light reflected by the second adjustment toner pattern into a second toner adhesion amount of the second adjustment toner pattern to change the image forming condition when in a second adjustment mode, form the first adjustment toner pattern and the second adjustment toner pattern such that a first image area of a first downstream region of the toner pattern bearer is identical to a second image area of a second downstream region of the toner pattern bearer, the first downstream region being downstream from the first adjustment toner pattern and defined by a circumferential length of the developer bearer during rotation of the toner pattern bearer, the second downstream image region being downstream from the second adjustment toner pattern and defined by the circumferential length of the developer bearer during rotation of the toner pattern bearer.

5. The image forming apparatus according to claim 4, wherein the controller is configured to, determine a target toner adhesion amount of the second adjustment toner pattern based on the first amount of reflection light reflected by the first adjustment toner pattern.

6. The image forming apparatus according to claim 4, wherein the non-image region is at a lateral end of the toner pattern bearer in the direction perpendicular during rotation of the toner pattern bearer.

7. The image forming apparatus according to claim 4, wherein the first image area is zero.

8. The image forming apparatus according to claim 4, wherein the first adjustment toner pattern includes a plurality of dotted patches, each of the plurality of dotted patches having different image areas.

9. The image forming apparatus according to claim 8, wherein the controller is further configured to, change an input signal for image processing based on a third amount of reflection light reflected by the plurality of dotted patches.

10. The image forming apparatus according to claim 9, wherein the controller is further configured to, form a third adjustment toner pattern on the first downstream region on the toner pattern bearer, and determine a target toner adhesion amount of the second adjustment toner pattern based on a fourth amount of reflection light reflected by the third adjustment toner pattern.

11. The image forming apparatus according to claim 4, wherein the controller is further configured to, form a third adjustment toner pattern, the third adjustment toner pattern is downstream from the second adjustment toner pattern on the toner pattern bearer during rotation of the toner pattern bearer to cause the first image area to be identical to the second image area.

12. The image forming apparatus according to claim 4, wherein the developer bearer includes a developing roller.

13. The image forming apparatus according to claim 4, wherein the toner pattern bearer includes an intermediate transfer belt.

14. The image forming apparatus according to claim 4, wherein the toner pattern bearer includes a photoconductor.

15. The image forming apparatus according to claim 4, wherein, the first adjustment toner pattern is on a center of the toner pattern bearer in the direction perpendicular during rotation of the toner pattern bearer, and the second adjustment toner pattern is on a lateral end of the toner pattern bearer in the direction perpendicular during rotation of the tuner pattern bearer.

16. The image forming apparatus according to claim 15, wherein the toner pattern detector includes:

a first sensor opposite the first adjustment toner pattern; and a second sensor opposite the second adjustment toner pattern.

17. The image forming apparatus according to claim 4, wherein the toner pattern detector includes an optical sensor, the optical sensor including:

a light-emitting element configured to emit light onto the toner pattern bearer;

a specular reflection light-receiving element configured to receive specular reflection light, the toner pattern bearer configured to reflect the specular reflection light; and a diffuse reflection light-receiving element configured to receive diffuse reflection light, the toner pattern bearer configured to reflect the diffuse reflection light.

18. The image forming apparatus according to claim 4, wherein the controller is further configured to decrease an error in the first toner adhesion amount and the second toner adhesion amount based on a detection result obtained by the toner pattern detector, the toner pattern detector is configured to detect the first adjustment toner pattern in the first downstream region and the second adjustment toner pattern in the second downstream region.

19. An image forming method, the method comprising:

determining a time to adjust an image forming condition;

forming a first adjustment toner pattern on a toner pattern bearer;

detecting, by an optical sensor, a first reflection light density of the first adjustment toner pattern;

obtaining a first relation between the first reflection light density and a developing bias;

calculating a toner density, the developing bias, and a charging bias of a charging roller based on the obtained first relation;

setting the calculated toner density, the calculated developing bias, and the calculated charging bias;

forming a plurality of dotted toner patches on the toner pattern bearer, each of the plurality of dotted toner patches having different image areas, a first set of the plurality of dotted toner patches being downstream from a second set of the plurality of dotted toner patches during rotation of the toner pattern bearer;

detecting, by the optical sensor, a second reflection light density of the plurality of dolled toner patches;

calculating an approximate third reflection light density based on a second relation between the second reflection light density and an output image signal received from the optical sensor;

determining the output image signal based on the calculated approximate; and determining a target image density.

20. The method according to claim 19, further comprising:

decreasing an error in the toner adhesion amount based on a detection result obtained by a toner pattern detector, the toner pattern detector is configured to detect the adhesion amount suppressing toner image on a downstream region.

* * * * *